US011519419B2

(12) United States Patent
Chiu

(10) Patent No.: US 11,519,419 B2
(45) Date of Patent: Dec. 6, 2022

(54) NON-SEALED VACUUM PUMP WITH SUPERSONICALLY ROTATABLE BLADELESS GAS IMPINGEMENT SURFACE

(71) Applicant: Kin-Chung Ray Chiu, Sunnyvale, CA (US)

(72) Inventor: Kin-Chung Ray Chiu, Sunnyvale, CA (US)

( * ) Notice: Subject to any disclaimer, the term of this patent is extended or adjusted under 35 U.S.C. 154(b) by 8 days.

(21) Appl. No.: 16/849,467

(22) Filed: Apr. 15, 2020

(65) Prior Publication Data

US 2021/0324863 A1 Oct. 21, 2021

(51) Int. Cl.

| | |
|---|---|
| ***F01D 1/36*** | (2006.01) |
| ***F04D 17/16*** | (2006.01) |
| ***F04D 21/00*** | (2006.01) |

(52) U.S. Cl.

CPC ..... *F04D 21/00* (2013.01); *F01D 1/36* (2013.01); *F04D 17/161* (2013.01); *F04D 17/168* (2013.01); *F05B 2240/20* (2013.01); *F05B 2260/60* (2013.01)

(58) Field of Classification Search

CPC ..... F04D 17/161; F04D 17/168; F01D 1/34

See application file for complete search history.

(56) References Cited

U.S. PATENT DOCUMENTS

| | | | | |
|---|---|---|---|---|
| 1,061,142 A | | 5/1913 | Tesla | |
| 1,061,206 A | | 5/1913 | Tesla | |
| 1,329,559 A | | 2/1920 | Tesla | |
| 2,910,223 A | * | 10/1959 | Schlumbohm | F04D 17/161 415/90 |
| 3,146,939 A | * | 9/1964 | Gorman | F04D 17/161 415/90 |
| 3,399,827 A | * | 9/1968 | Schwartzman | F04D 19/042 417/406 |

(Continued)

FOREIGN PATENT DOCUMENTS

| | | | | |
|---|---|---|---|---|
| FR | 439542 | * | 4/1911 | F04D 17/161 |
| GB | 179043 A | | 5/1922 | |

(Continued)

OTHER PUBLICATIONS

Mahistre, Translation of FR439542, Jun. 15, 1912 (Year: 1912).*

(Continued)

*Primary Examiner* — Courtney D Heinle
*Assistant Examiner* — Michael K. Reitz

(57) ABSTRACT

A vacuum pump generally comprises a low pressure portion and a high pressure portion separated by a gas impermeable partition. Gas molecules exit the low pressure portion through an opening in the partition and passively impinge on a featureless rotatable surface in the high pressure portion. A drive rotates the rotatable surface with tangential velocity in the supersonic range at multiple times the most probable velocity of the impinging gas molecules. Impinging gas molecules are ejected outwardly from the periphery of the rotatable surface generating a substantial net outward flow of gas and reducing the pressure in the low pressure portion. The vacuum pump is effective to reduce the pressure in the low pressure portion to a target minimum pressure without using seals to prevent gas molecules from leaking back to the low pressure portion and without using blades or vanes to actively impact the gas molecules.

22 Claims, 11 Drawing Sheets

(56) References Cited

U.S. PATENT DOCUMENTS

| | | | | |
|---|---|---|---|---|
| 5,709,528 | A | 1/1998 | Hablanian | |
| 5,947,694 | A | 7/1999 | Hablanian | |
| 6,179,573 | B1 | 1/2001 | Hablanian | |
| 6,193,461 | B1 | 2/2001 | Hablanian | |
| 6,220,824 | B1 | 4/2001 | Hablanian | |
| 6,227,796 | B1 * | 5/2001 | Markovitch | F04D 5/001 415/199.1 |
| 6,238,177 | B1 * | 5/2001 | Conrad | F01D 1/36 415/1 |
| 6,394,747 | B1 * | 5/2002 | Hablanian | F04D 17/168 415/55.1 |
| 6,435,811 | B1 | 8/2002 | Beyer | |
| 6,607,351 | B1 | 8/2003 | Hablanian | |
| 6,767,192 | B2 | 7/2004 | Hablanian | |
| 7,223,064 | B2 | 5/2007 | Hablanian | |
| 7,445,422 | B2 | 11/2008 | Hablanian | |
| 7,628,577 | B2 | 12/2009 | Hablanian | |
| 8,106,354 | B2 | 1/2012 | Henry | |
| 8,523,539 | B2 * | 9/2013 | Gill | F04D 29/048 417/423.12 |
| 8,790,070 | B2 | 7/2014 | Klingner | |
| 8,926,266 | B2 | 1/2015 | Beyer | |
| 8,992,162 | B2 | 3/2015 | Henry | |
| 2003/0202874 | A1 | 10/2003 | Hablanian | |
| 2004/0091364 | A1 | 5/2004 | Hablanian | |
| 2005/0214108 | A1 * | 9/2005 | Hayes | F01D 1/36 415/90 |
| 2006/0177300 | A1 | 8/2006 | Hablanian | |
| 2006/0257249 | A1 | 11/2006 | Hablanian | |
| 2008/0056885 | A1 | 3/2008 | Hablanian | |
| 2008/0056886 | A1 * | 3/2008 | Hablanian | F04D 29/403 415/90 |
| 2008/0253903 | A1 | 10/2008 | Hablanian | |
| 2010/0176294 | A1 | 7/2010 | Henry | |
| 2010/0187415 | A1 | 7/2010 | Schneiders | |
| 2010/0266426 | A1 | 10/2010 | Hablanian | |
| 2011/0081231 | A1 | 4/2011 | Hoelzer | |
| 2011/0123328 | A1 | 5/2011 | Henry | |
| 2011/0135506 | A1 | 6/2011 | Henry | |
| 2011/0150629 | A1 | 6/2011 | Klingner | |
| 2011/0255999 | A1 | 10/2011 | Adamietz | |
| 2011/0311348 | A1 | 12/2011 | Beyer | |
| 2012/0087776 | A1 | 4/2012 | Henry | |
| 2016/0290343 | A1 | 10/2016 | Henry | |
| 2018/0266250 | A1 * | 9/2018 | Lockhart | F01D 1/36 |
| 2019/0145418 | A1 * | 5/2019 | Stansbury | F04D 29/324 415/199.2 |
| 2019/0195242 | A1 * | 6/2019 | Chen | F04D 17/08 |
| 2020/0191168 | A1 * | 6/2020 | Kosmicki | F04D 29/281 |

FOREIGN PATENT DOCUMENTS

| | | | |
|---|---|---|---|
| GB | 186082 | A | 9/1922 |
| GB | 186083 | A | 9/1922 |
| GB | 186084 | A | 9/1922 |
| GB | 186799 | A | 10/1922 |

OTHER PUBLICATIONS

Umrath, Fundamentals of Vacuum Technology, Brochure, Jun. 2007, Oerlikon Leybold Vacuum, pp. 1-197.

Basic principles of vacuum technology, brief overview - Introduction, Catalog, Festo Corporation, www.festo.com/catalogue/, pp. 1-54.

Knudsen No. Internet article, https://en.wikipedia.org/wiki/Knudsen_number.

Jcer, Vacuum Technology, Presentation, Jan. 2010, 23 pgs.

Navier-Stokes equations, Internet article, https://en.m.wikipedia.org/w/index.php?title=Navier-Stokes_equations.

Chew, Mechanical vacuum pumps, Article, BOC Edwards, Crawley, United Kingdom, pp. 43-64.

Vacuum Pump Technologies Explained, Article, Vacuum Science World, pp. 1-22.

Could a bladeless "Tesla Turbine" type air compressor be used as a high vacuum pump?, Internet communication2.

Nikola Tesla Disc Turbine/Pump, p. 1, Internet collection of articles and patents, www.rexresearch.com.

Nikola Tesla Disc Turbine/Pump. p. 2, Internet collection of British patents, www.rexresearch.com.

Nikola Tesla Disc Turbine/Pump. p. 3, Internet collection of articles, www.rexresearch.com.

* cited by examiner

NON-SEALED VACUUM PUMP WITH SUPERSONICALLY ROTATABLE BLADELESS GAS IMPINGEMENT SURFACE

CROSS-REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

1. Field of the Invention

The invention relates generally to the field of pumps and more specifically mechanical vacuum pumps for pumping various gases to lower pressures. More particularly the invention relates to a mechanical vacuum pump with a gas impingement surface that is rotatable at supersonic tangential velocity to pump impinging gas molecules without the use of seals or protruding or angled blades or vanes.

2. Description of Related Art

Any discussion of the related art throughout the specification is not intended as and should in no way be considered as an admission that such related art is in fact prior art, or is widely known, or forms any part of common general knowledge in the field.

There are a number of different types of mechanical pumps adapted for pumping various gases and gas mixtures, including gases such as water vapor, nitrogen, hydrogen, oxygen, chlorine, carbon dioxide, methane, etc., and gas mixtures such as air, hydride gases, halogen gases, perfluorocarbon gases mixed with oil, water, oxidant gases or inert gases, etc. Such pumps are used for a variety of purposes including among others to transfer gases from one space or location to another and to evacuate gas from a space to reduce the pressure in the space. Such pumps find use in diverse applications including household vacuum cleaners, oil and gas production, distribution, and storage, low pressure drying applications, semiconductor fabrication, coating applications, chemical manufacturing processes, scientific research where low pressure is required.

Pumps used to evacuate gas molecules from a space to reduce the pressure in the space are sometimes referred to as vacuum pumps because by operating to reduce the pressure in the space relative to the surrounding environment the pumps are able to create a partial vacuum. The highest level of vacuum, i.e., the lowest pressure, these types of pumps are able to produce typically depends on their particular designs and operations. Various applications require different values and ranges of reduced pressure. For example some applications may operate at pressures in the range of about 20-50% of atmospheric pressure (atm), i.e., down to about 0.5 atm. Other applications, including many semiconductor fabrication applications, may require much lower pressures in the mid-high vacuum range, e.g., $10^{-4}$ to $10^{-6}$ atm. In some applications, even lower pressures into the ultra-high vacuum range are sometimes required, such as for particle accelerators and surface physics research. Various types of vacuum pumps are used to produce such levels of low pressure. Such pumps include positive displacement pumps, such as rotary vane pumps, piston pumps, diaphragm pumps, screw pumps, dry pumps, and roots blowers; and momentum transfer pumps, which include turbo-molecular and molecular drag pumps. All of the above-mentioned pumps are mechanical pumps in contrast with the example embodiments described in the present application Positive displacement vacuum pumps are generally designed and operate to move a constant displacement of gas during each pumping cycle at a substantially constant volume compared to typical momentum transfer pumps. Accordingly, as the pressure of the gas being pumped drops substantially below atmospheric pressure such pumps generally become less and less efficient at evacuating additional gas molecules and eventually are unable to further reduce the pressure. Positive displacement vacuum pumps commonly are only capable of reducing pressure from about 1 atm to the $10^{-4}$ atm range without the use of additional pumps or pumping stages in combination. A pumping stage refers to a unit set of pumping components with gas flow paths that lead to other vacuum components or a similar unit set of pumping components.

In contrast, turbo-molecular and molecular drag pumps typically employ blade structures that protrude or are angled upwardly and/or downwardly with respect to a plane of rotation. This increases the intercepting cross-section and surface area in contact with molecules and to actively intercept and increase the number of molecules to be impacted and have the rotational momentum of the blades transferred to them. These types of pumps also operate at much higher rates of rotational speed than typical positive displacement pumps and are thus capable of pumping gases at lower pressure more efficiently than typical positive displacement pumps including at pressures below about $10^{-4}$ atm. However, turbo-molecular and molecular drag pumps are not effective or efficient at pumping gases at relatively higher pressures closer to ambient atmospheric pressure at least in part due to the substantial effects of drag due to the transfer of momentum and kinetic energy loads of the impacted gas molecules on the high speed rotating blades and other rotational components. In practical use, turbo-molecular and molecular drag pumps are not practically effective until the gas being pumped is already in a reduced pressure range below about $10^{-3}$ to $10^{-4}$ atm. Further, such pumps are sensitive to even quite small back-pressure gradients, which can cause them to stall when attempting to pump gases into exhaust spaces having higher pressures. Accordingly, such pumps are not effective or efficient on their own either to pump down gases from higher pressures closer to atmospheric pressure or to pump gases out directly to the ambient atmosphere. Accordingly, turbo-molecular and molecular drag pumps are typically employed in combination with one or more outlet-side (foreline) pumps that first reduce the pressure of an exhaust space to a relatively low pressure into which the turbo-molecular or molecular drag pump can pump gas effectively without stalling.

Thus, one deficiency of conventional mechanical vacuum pumps is that commonly a single conventional pump is not capable of effectively and efficiently pumping the pressure down over a relatively wide range from about 1 atm to about $10^{-4}$ atm, $10^{-6}$ atm, or lower. Instead multiple pumps and pumping stages are required, which entails substantial additional cost, increased maintenance, increased use of valuable space, and increased risk of failure of multiple components and breakdowns.

Another deficiency is that many conventional mechanical vacuum pumps employ some form of interconnected or intermeshed rotors and stators of various shapes, such as rotors with blades, vanes, pitches, gears, claws, impellers, or similar protruding surfaces to actively physically contact and push the molecules of gas being pumped toward another pumping stage or an outlet. In addition, such pumps generally require various seals, sealants, lubricants, etc. The use of such structures to actively physically contact and push the gas molecules generates substantial drag which, together with the heavy mass of the rotating components, produces mechanical friction and wear, and physical and chemical deterioration of seals, sealants and lubricants. This in turn limits the range of rotational speeds of the rotating components and hence the range of pressures over which such pumps can operate effectively and efficiently. Further, to the extent that the gases or gas mixtures being pumped are caustic, corrosive, or contain abrasive particles or powders, repeated active high-speed collisions with such chemical and abrasive particles can accelerate and increase wear and damage to the moving and non-moving components of the pump. Still further, rapidly repeated high-speed collisions with gas molecules and other particles can generate a significant amount of adiabatic compression heat which can further exacerbate the wear and damage to pump components as well as adversely affect the efficiency and effective pressure range of the pump.

Still other problems and shortcomings of conventional mechanical vacuum pumps are that they commonly have complicated designs with numerous interconnected or intermeshed moving and non-moving components, require lengthy and very fine dimensional tolerances between such moving and non-moving components in order to reduce the conductance of the gas flow path and to increase gas leak back flow path resistance, and typically require the use of one or more stages and seals between high and low pressure sides and/or between pumping stages to prevent gas leak back and loss of pumping efficiency. Even in certain vacuum pumps where a low pressure side or inlet is not sealed from a high pressure side or outlet, sealing is still typically required between the low pressure sides of subsequent pumping stages either within the same pump housing or between successive pumps to prevent gas ultimately leaking back.

Tesla and Gaede about a century ago experimented with vacuum pump designs that used bladeless disks or cylinders. However, in the Tesla pump designs the rotating surfaces of the disks or cylinders only rotated at relatively low subsonic velocities. The Tesla experiments were not particularly successful and did not produce vacuum pumps that could effectively and efficiently pump gas from a low pressure side of a pump over a wide range of pressures from about 1 atm down to the mid-high vacuum range, e.g., about $10^{-6}$ atm or even lower without the use of additional pumps or multiple pumping stages. Further, the Tesla experiments did not result in pumps capable of pumping gas over such a wide range of pressures without the need to use one or more seals to prevent gas leak-back to the low pressure side of the pump or between pumping stages. Still further, the Tesla pump designs did not address how to maintain pumping efficiency with dropping pressure over a wide range of pressures and as a result the pump designs were practically capable of effective operation over only a fairly limited range of pressures and at relatively high pressure ranges. Accordingly, the Tesla pumps have not been widely adopted for practical uses over the last century but have largely remained technical curiosities. In contrast, the Gaede pumps have evolved into the present-day turbo-molecular and molecular drag pumps with protruding angled blades and with all the limitations of such pumps as described above.

There remains a need for a vacuum pump that addresses the various deficiencies, problems, and shortcomings of the conventional mechanical vacuum pumps noted above as well as others. The several example embodiments of a non-sealed vacuum pump with supersonically rotatable bladeless gas impingement surface shown and described in detail herein provide such a pump.

BRIEF SUMMARY OF THE INVENTION

A non-sealed vacuum pump with supersonically rotatable bladeless gas impingement surface comprises a low pressure portion and a high pressure portion separated by a stationary substantially gas impermeable partition. A gas flow path for a gas to flow from the low pressure portion to the high pressure portion extends through the partition. No seals and no pressure differential pumping stages present to prevent the gas from leaking back from the high pressure portion to the low pressure portion through the gas flow path. A rotatable surface, which may be substantially planar, tapered, or another shape, but without blades, vanes, impellers or other substantial protrusions is positioned within a space in the high pressure portion. The rotatable surface is featureless in order to minimize drag due to impact with gas molecules as it rotates. The rotatable surface is adapted to be passively impinged on by molecules of the gas entering the space. A drive is coupled to the rotatable surface and is adapted to rotationally drive the rotatable surface so that at least a portion of the rotatable surface rotates with a tangential velocity in a supersonic speed range of approximately 1 to 6 times the most probable velocity of the molecules of the gas impinging on the rotatable surface. In that tangential velocity range, the rotatable surface redirects and ejects impinging gas molecules substantially directly outwardly from its periphery at a high velocity and at a rate and volume to reduce the pressure of the gas in the low pressure portion down to a selected target minimum pressure before randomly moving low velocity gas molecules can leak back from the high pressure portion to the low pressure portion at a rate and volume to limit further reducing the pressure of the gas in the low pressure portion. One target minimum pressure may be approximately 0.5 atm. Another target minimum pressure may be about $10^{-6}$ atm.

According to one aspect, the partition has a stationary surface that is exposed to the high pressure portion and the rotatable surface has a rotatable surface that faces the stationary surface of the partition. The facing surfaces are separated by a gap, space or distance having a dimension between approximately 0.5 mm and approximately 100 mm, which may and preferably does continue around substantially the entire peripheral edge of the rotatable surface.

According to another aspect, the rotatable surface may comprise a thin planar or tapered disk and according to another aspect the rotatable surface may comprise a thin planar or tapered ring with open interior portions. The rotatable surface also may comprise another shape, such as a conical-shape or crown-shape disk or ring, however regardless of the shape selected it is preferred that the rotatable surface be free of any features that protrude outwardly from the surface. The rotatable surface has a periphery with a peripheral surface portion that extends around the periphery, an axis of rotation, and a first width dimension between the axis of rotation and the periphery. The peripheral surface portion preferably has a second width dimension that is approximately 0.05 to 0.5 times the first width dimension according to one aspect of the invention, and up to 1 times the first width dimension according to another aspect of the invention.

According to another aspect, a plurality of substantially parallel rotatable surfaces are arranged in a stacked configuration and can be rotated together as a unitary structure or separately and independently of each other.

According to yet another aspect, the rotatable surface is positioned within an interior space defined by an open outer housing, chamber, or enclosure with a wall that is stationary and substantially gas impermeable. The rotatable surface is positioned within the interior space to divide the interior space into a low pressure portion and a high pressure portion. The low pressure and high pressure portions are in gaseous communication and no seal is present to prevent gas from leaking from the high pressure portion to the low pressure portion. The rotatable surface is adapted to be impinged on by molecules of the gas in both the low pressure portion and the high pressure portion. The drive is adapted to rotationally drive the rotatable surface so that at least a portion rotates with tangential velocity in the supersonic speed range of approximately 1 to 6 times the most probable velocity of the molecules of the gas impinging on the rotatable surface. In that tangential velocity range, the rotatable surface redirects and ejects impinging gas molecules outwardly from its periphery at high velocity and at a rate and volume to reduce the pressure of the gas in the low pressure portion down to a selected target minimum pressure before randomly moving low velocity gas molecules can leak back from the high pressure portion to the low pressure portion at a rate and volume to limit further reducing the pressure of the gas in the low pressure portion. One target minimum pressure may be approximately 0.5 atm. Another target minimum pressure may be about $10^{-6}$ atm.

According to another aspect, the wall of the housing, chamber, or enclosure has an interior surface that extends around the rotatable surface and that with the rotatable surface defines the low pressure portion. The interior surface is sloped outwardly in the vicinity of the peripheral edge of the rotatable surface to direct gas molecules ejected outwardly from the rotatable surface away from the peripheral surface. The peripheral edge of the rotatable surface is separated from the interior surface by a gap, space, or distance having a dimension between approximately 0.5 mm and approximately 100 mm, which may and preferably does continue around substantially the entire peripheral edge of the rotatable surface.

According to yet another aspect, the rotatable surface has a first rotatable surface exposed to the low pressure portion and a second rotatable surface exposed to the low pressure portion. A substantially gas impermeable enclosure in the high pressure portion encloses a region of space around the rotatable surface and has an opening that is adjacent to and that is separated from the second surface by a small gap in order to create a region of low pressure adjacent to the second rotatable surface.

DETAILED DESCRIPTION OF PREFERRED EMBODIMENTS

Figure 1:
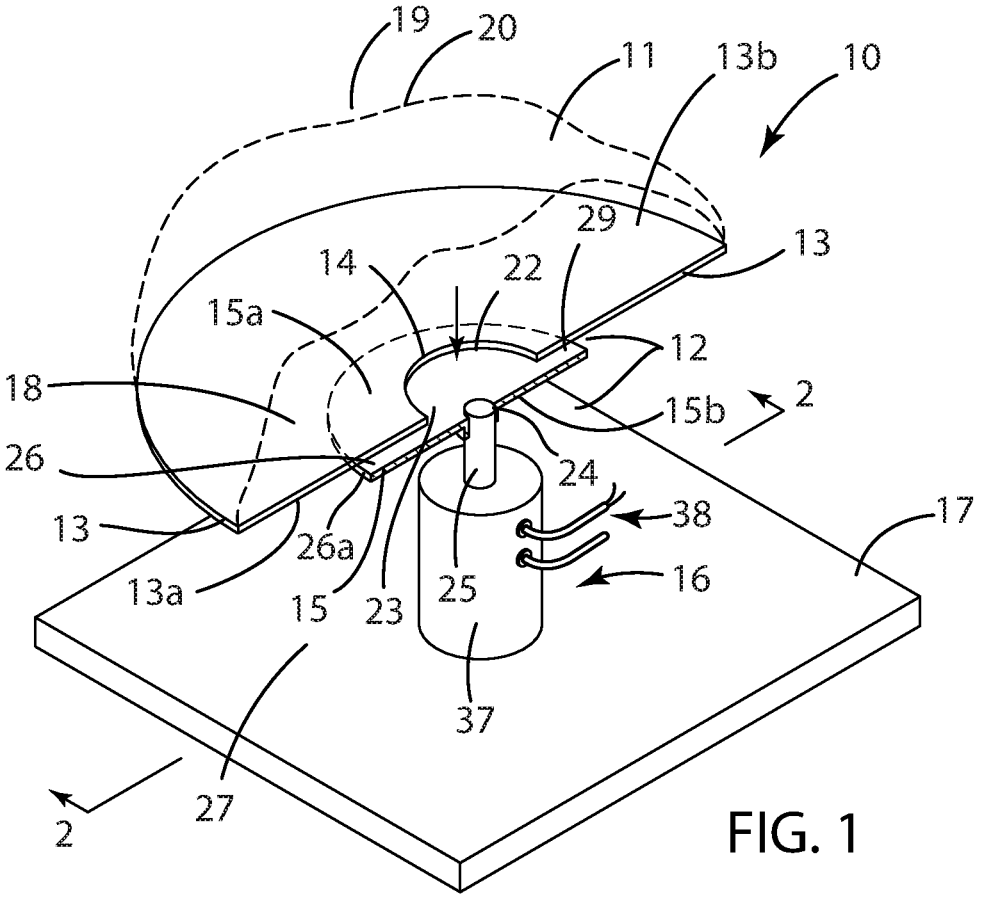
FIG. 1 is a top perspective view partially in cross section and partially transparent of a non-sealed single stage vacuum pump with a bladeless gas impingement surface rotatable at supersonic speed according to an example embodiment.

A detailed description of example embodiments is given below with reference to FIGS. 1-12 of the attached drawing wherein like reference numerals refer to like parts throughout the various views unless otherwise specified. The detailed description is given by way of illustration only and is not intended to limit the scope of the invention, which is defined by the appended claims. Further, the detailed description is not intended to be limiting or exhaustive with regard to example embodiments that may be possible in accordance with the invention. Rather, it is contemplated that various modifications to the example embodiments as described will be appreciated by those skilled in the art in accordance with the invention. It is also contemplated that those skilled in the art will appreciate that various features and elements of the example embodiments as described may be combined with various features and elements of other example embodiments, thus resulting in additional example embodiments also in accordance with the invention.

Certain definitions and conventions have been adopted and are used in connection with the detailed description herein. Unless otherwise specified, the term "vacuum" as used herein to refer to example embodiments of a "vacuum" pump is not intended to and does not necessarily mean that the pump is intended to be used or must be capable of pumping to a complete vacuum. Rather, "vacuum" is merely used as a shorthand descriptor for a pump that is intended to be used and has the capability to reduce the gas pressure in a low pressure portion of the pump to a pressure sufficiently less than the starting or ambient pressure to generate a partial vacuum. For example, the starting or ambient pressure may but need not be atmospheric pressure (atm) and the pump may be capable of pumping down to a pressure less than atm, e.g., 0.5 atm, $10^{-6}$ atm, $10^{-6}$ atm or lower. It should be understood that the lowest pressure value that the "vacuum" pump is intended and able to produce will depend on the details of construction and operation of a particular pump according to the detailed description herein. Unless otherwise specified, all references to pressure, temperature, and other physical parameters, e.g., most probable velocity, mean free path, impinging rate, etc. herein are in relation to and/or with reference to temperature at 20° C. and pressure at 1 atm (760 Torr, 101,325 Pa., 1013.25 mbar) where the gas is air. Further, by way of example in the following description, air will be used as the gas being pumped. It will be appreciated however, that the example embodiments of the vacuum pump 10 are intended and suitable for use not only with air, but also with other gases and mixtures of gases including by way of example and without limitation, water vapor, nitrogen, hydrogen, oxygen, chlorine, carbon dioxide, methane, etc., and various gas mixtures such as air, hydride gases, halogen gases, perfluorocarbon gases mixing with oil, water, oxidant gases or inert gases, etc. This invention find use in diverse applications including household vacuum cleaners, oil and gas production, distribution, and storage, low pressure drying applications, semiconductor fabrication, coating applications, chemical manufacturing processes, and scientific research where low pressure is required.

Figure 2:
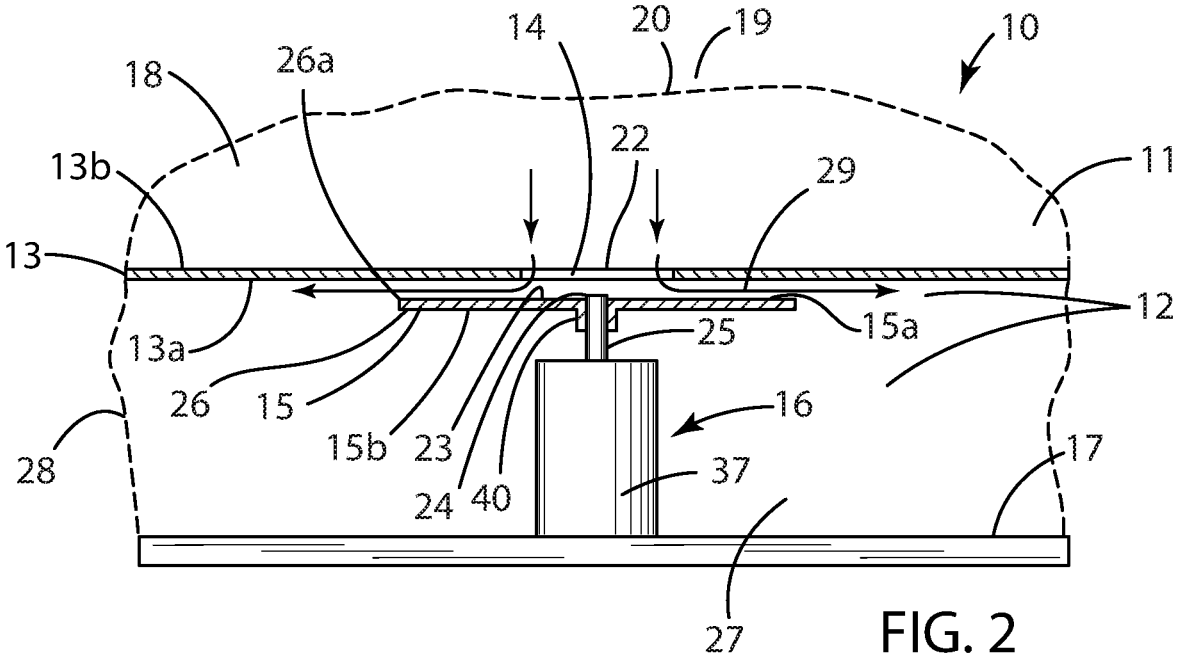
FIG. 2 is a cross-sectional view of the non-sealed vacuum pump with bladeless gas impingement surface rotatable at supersonic speed of FIG. 1.
Figure 3:
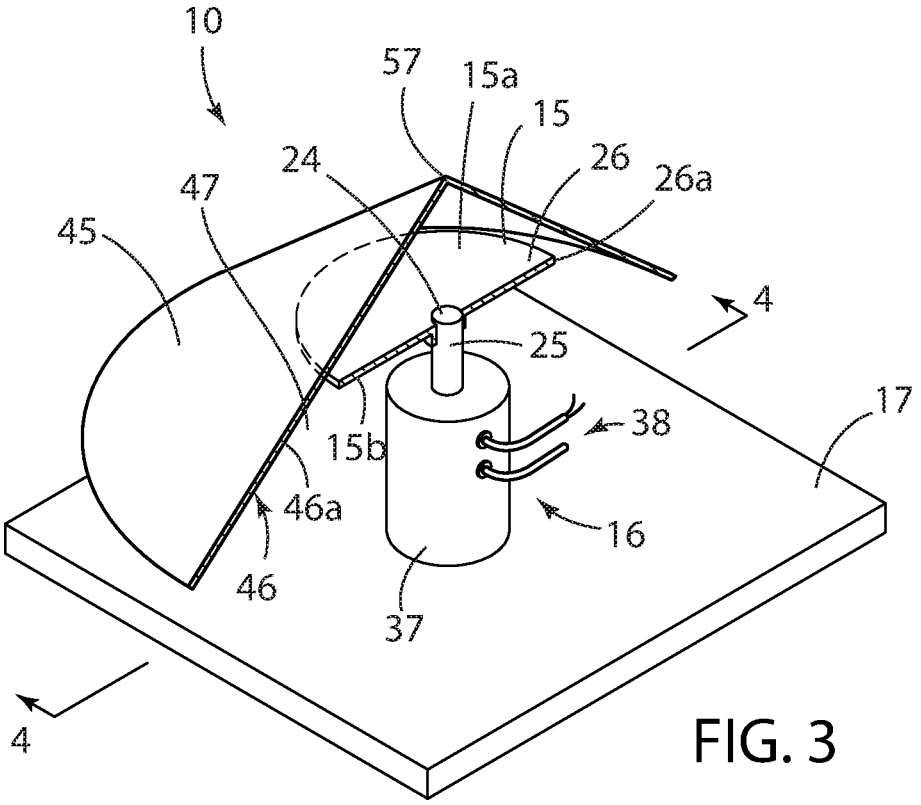
FIG. 3 is a top perspective view partially in cross section and partially transparent of a non-sealed vacuum pump with a bladeless gas impingement surface rotatable at supersonic speed according to another example embodiment.
Figure 4:
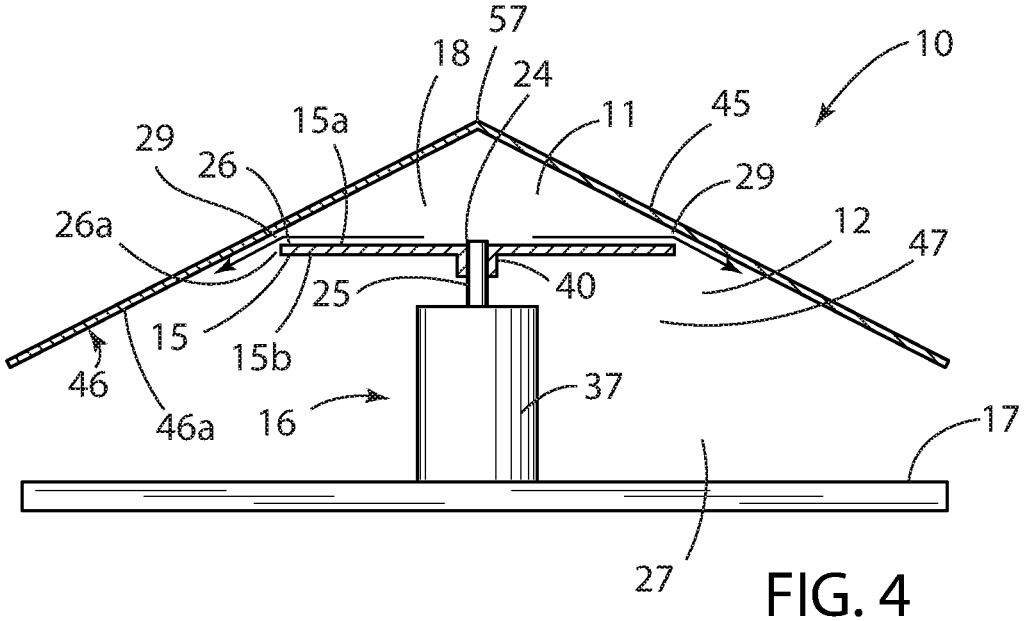
FIG. 4 is a cross-sectional view of the non-sealed vacuum pump with a bladeless gas impingement surface rotatable at supersonic speed of FIG. 3.
Figure 5:
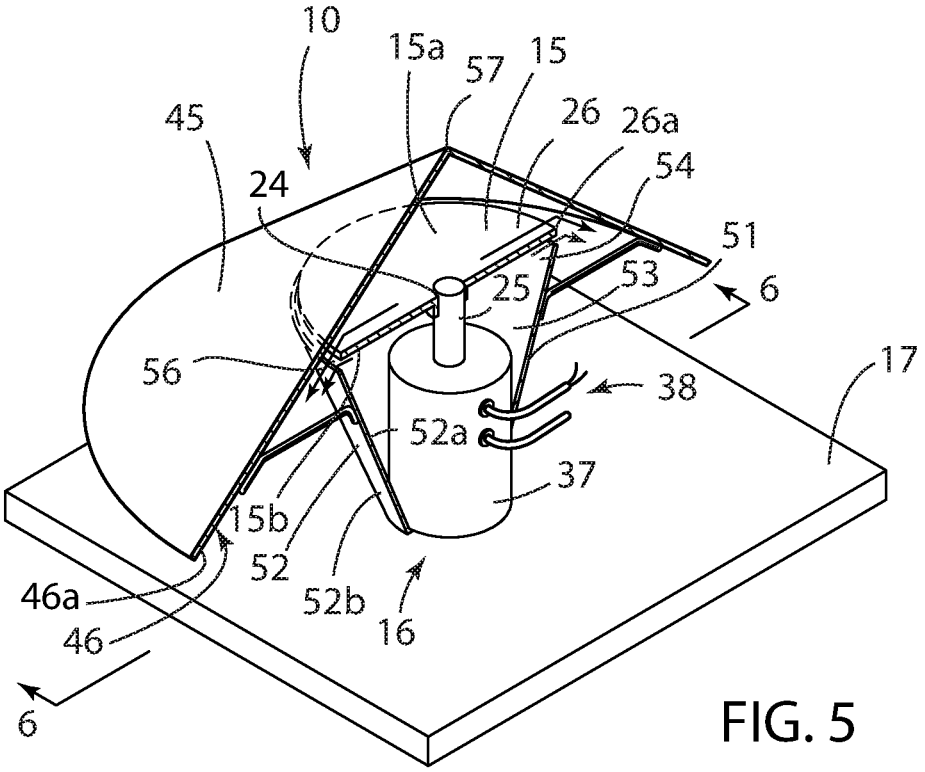
FIG. 5 is a top perspective view partially in cross section and partially transparent of a non-sealed vacuum pump with a bladeless gas impingement surface rotatable at supersonic speed according to yet another example embodiment.

One example embodiment of a vacuum pump 10 according to the invention is illustrated in FIGS. 1-2. In general, the vacuum pump 10 comprises a low pressure portion 11, a high pressure portion 12, a partition 13 that separates the low pressure portion 11 from the high pressure portion 12, a gas flow path 14 through the partition 13, a substantially planar rotatable surface 15, and a drive 16 adapted to cause at least a portion of the rotatable surface 15 to rotate at a very high rate of tangential velocity as described in further detail below. The vacuum pump 10 may be portable or may be mounted in a permanent or semi-permanent position, for example to a stationary fixed base or surface of a structure 17.

As indicated by the dashed outline in FIGS. 1-2, the low pressure portion 11 may comprise an enclosed, partially enclosed/partially open, or open region or space 18. The low pressure portion 11 may have any desired geometric shape. For example, the low pressure portion 11 and the region or space 18 can be partially or completely dome-shaped, or can be cylindrical, rectangular, conical, frusto-conical or any other suitable geometric shape.

The low pressure portion 11 may comprise an enclosed interior space 18 of a closed housing, chamber, or other enclosure. As indicated above, the housing or chamber and the interior space may have any desired geometric shape and configuration. The low pressure portion 11 also may comprise a partially enclosed/partially open space 18 of any desired geometric shape or even an open region or space. In the case of a partially enclosed/partially open space 18, the low pressure portion 11 may comprise the portion of the partially enclosed/partially open space 18 that is enclosed as well as a region or space 19 that is exterior to the enclosed space 18 and closely adjacent to one or more openings 20. For example, the low pressure portion 11 may comprise the interior space 18 enclosed within a housing or chamber that has one or more openings 20, as well as a relatively narrow portion or region of the space 19 that is exterior and closely adjacent to the openings 20. One or more openings 20 may comprise a gas inlet 21 that is in gaseous communication with the low pressure portion 11 and that may be coupled to or in gaseous communication with another housing or chamber, a gas conduit, or even the external ambient environment.

In the case of an open space 18, the low pressure portion 11 may comprise a relatively narrow portion or region of the open space 18 that is external and closely adjacent to an opening 22 of the gas flow path 14 through the partition 13 that separates the low pressure portion 11 and the high pressure portion 12. As a result and as will become apparent from the description herein, the low pressure region exerts a pulling force on the rotatable surface 15. Therefore, the rotatable surface 15, central opening 24, drive shaft 25, coupler 40, drive motor 37, and base 17 are preferably designed and assembled to be structurally resistant to the pulling force and to maintain a substantially fixed and constant position of the rotatable surface 15 in relation to the partition 13 during operation of the vacuum pump 10.

The partition 13 is substantially gas impermeable and is stationary in relation to the rotatable surface 15. The partition has one side with a surface 13*a* that is exposed to the high pressure portion 12 and another side opposite the one side with a surface 13*b* that is exposed to the low pressure portion 11. The partition 13 may comprise a substantially planar structure as illustrated in FIGS. 1-2, or may be curved or formed in other geometric shapes. The partition 13 functions to effectively separate the low pressure portion 11 and the high pressure portion 12 at least in the vicinity of the rotatable surface 15. The partition 13 may but need not be incorporated as part of a housing, chamber or other enclosure that encloses the low pressure portion 11, the high pressure portion 12, or both. In some embodiments, either or both of the low pressure portion 11 and the high pressure portion 12 can be partially or completely open to the external environment save for the partition 13 between them. The partition 13 should extend adjacent to the preferably substantially planar rotatable surface 15 between the low pressure portion 11 and the high pressure portion 12 for a distance relative to the peripheral dimension of the rotatable surface 15 that is sufficient to effectively separate the high pressure portion 12 from the low pressure portion 11 at least in the vicinity of the rotatable surface 15. Although for illustrative purposes, FIGS. 1 and 2 show the partition 13 extending well past the peripheral edge 26*a* of the rotatable surface 15, in most practical applications the partition 13 will preferably have a dimension that is approximately the same as or slightly greater than the dimension of the diameter of the rotatable surface 15 so that the partition 13 extends to or slightly past the peripheral edge 26*a* of the rotatable surface 15. Further, in the vicinity of the gas flow path 14 through the partition 13, the rotatable surface 15 will preferably have sufficient structural rigidity and integrity to effectively separate the high pressure portion 12 from the low pressure portion 11 without substantial deformation or damage.

The gas flow path 14 extends through the partition 13 and provides a path for gas to flow between the low pressure portion 11 and the high pressure portion 12. The gas flow path 14 may comprise one or more openings 22 in the partition 13, one or more pipes or conduits, and/or any other structure or combination that enables gas to flow in a confined path from one point to another, or any combination of these. The gas flow path 14 is preferably located and configured so that molecules of gas flow from the low pressure portion 11 through the gas flow path 14 to the high pressure portion 12 and impinge on the rotatable surface 15. The gas flow path 14 may comprise an opening 22 into the high pressure portion 12 that is adjacent to a central portion 23 of the rotatable surface 15 as in the example embodiment illustrated in FIGS. 1-2. The central portion 23 includes a central opening 24 that along with a drive shaft 25 of the drive 16 described in further detail below defines an axis of rotation of the rotatable surface 15. The opening 22 in the partition 13 may but need not have a center point or axis that is coaxial with the axis of rotation of the rotatable surface 15. The opening 22 in the partition 13 may also be located offset from the central opening 24, central portion 23, and/or axis of rotation of the rotatable surface 15 by a selected radial distance toward an outer periphery 26 of the rotatable surface 15. The gas flow path 14 may also comprise multiple spaced openings 22 that are interspersed or distributed in the partition 13. The multiple openings 22 may include an opening that is located adjacent to the central portion 23, central opening 24, and/or the axis of rotation of the rotatable surface 15, and/or one or more openings that are located at the same radial distance or a plurality of different radial distances from the axis of rotation of the rotatable surface 15 toward the outer periphery 26 of the rotatable surface 15.

The gas flow path 14 and/or the one or more openings 22 through the partition 13 into the high pressure portion 12 may but need not have an axis that is substantially perpendicular to a plane of rotation of the rotatable surface 15, which is described further below. The gas flow path 14 and/or the one or more openings 22 also may have the same or different axes at one or more angles in relation to the plane of rotation of the rotatable surface 15. The one or more angles may be one or more acute angles in relation to the plane of rotation of the rotatable surface 15 and may slope or extend outwardly toward the outer periphery 26 of the rotatable surface 15.

It will be appreciated from the foregoing description that the gas flow path 14 and the openings 22 can be arranged in relation to the plane of rotation of the rotatable surface 15 to impart to at least some extent a directional bias to at least some portion of the gas molecules entering the high pressure portion 12 so that they are at least somewhat more likely to impinge on the rotatable surface 15 at one or more selected locations between the axis of rotation and the periphery 26, for example locations rotating with higher tangential velocity, and are at least somewhat more likely to impinge on the rotatable surface 15 at angles in relation to the plane of rotation that are sloped toward the periphery 26 of the rotatable surface 15. Such arrangements can thus contribute positively to the efficiency of the vacuum pump 10.

Like the low pressure portion 11, the high pressure portion 12 may comprise a partially enclosed/partially open or open region or space 27. The high pressure portion 12 may have any desired geometric shape. For example, the high pressure portion 12 can be cylindrical, cubic, rectangular, conical, frusto-conical or any other desired geometric shape.

Also for example, the high pressure portion 12 may comprise the enclosed interior space 27 of a housing, chamber, or other enclosure having one or more openings 28. As indicated above, the housing or chamber and the interior space 27 may have any desired geometric shape and configuration. One or more of the openings 28 may comprise a gas outlet in gaseous communication with the high pressure portion 12. The gas outlet also may be coupled to or in gaseous communication with another chamber, a gas conduit, or the external ambient environment. The high pressure portion 12 also may comprise an open region or space 27 that is unbounded by a housing, chamber or other structure except the partition 13 as described above that separates the high pressure portion 12 from the low pressure portion 11. The open region or space 27 may be the external ambient environment. In that case, the tangentially outward flow of impinging gas molecules from the outer periphery 26 of the rotatable surface 15 as indicated by the arrows in FIG. 2 may be thought of as comprising a gas outlet.

It is a unique characteristic of the example embodiments described herein that there is no need for a seal or seals to prevent gas molecules from leaking back from the high pressure portion 12 to the low pressure portion 11 through the gas flow path 14 and it is preferred that no seals are used for that purpose. The reasons for this will become apparent from the additional descriptions below. Because no leak-back seals are employed, the example embodiments of the vacuum pump 10 described herein can be constructed with fewer moving parts, fewer parts requiring inspection, maintenance, repair or replacement, and less demanding tolerances. Accordingly, the example embodiments of the vacuum pump 10 are less costly to construct, assemble, and operate and are more reliable than conventional vacuum pumps.

The rotatable surface 15 has a first side with a rotatable first surface 15*a*, a second side with a rotatable second surface 15*b* that is opposite the first surface 15*a* and a peripheral edge 26*a* that extends between the first surface 15*a* and the second surface 15*b* around the periphery 26 of the rotatable surface 15. The rotatable surface 15 is preferably positioned in the region or space 27 of the high pressure portion 12 adjacent and in relatively close proximity to the partition 13 and the gas flow path 14 and opening or openings 22 through the partition 13. More specifically, the rotatable surface 15 is preferably positioned with the first surface 15*a* facing, adjacent to and in relatively close proximity to the surface 13*a* of the partition 13 that is exposed to the high pressure portion 12 and the gas flow path 14 and openings 22 in the partition 13. Preferably, but not necessary in all embodiments, the rotatable surface 15 is positioned so that the first surface 15*a* is substantially parallel with the surface 13*a* of the partition 13 that is exposed to the high pressure portion 12 and is substantially perpendicular or at a selected angle with respect to the axes of the gas flow path 14 and/or openings 22 in the partition 13. The first surface 15*a* of the rotatable surface 15 and the surface 13*a* of the partition 13 that is exposed to the high pressure portion 12 are separated by a small space or gap 29 so that a very large portion of gas molecules entering through the openings 22 into the high pressure portion 12 are likely to impinge on the first surface 15*a*. For reasons that will become apparent from further description below, the space or gap 29 is preferably in the range of approximately 0.5 mm to approximately 100 mm to facilitate operation of the vacuum pump 10 with a wide variety of gases and minimum target pressure values.

In some example embodiments, such as those illustrated in FIGS. 1-8, the rotatable surface 15 is substantially planar with the first surface 15*a* being substantially planar, the second surface 15*b* being substantially planar, and the first surface 15*a* and the second surface 15*b* being substantially parallel and co-extensive, and terminating in the peripheral edge 26*a* that extends around the periphery 26 of rotatable surface 15. The peripheral edge 26*a* may but need not be substantially perpendicular to the first and second substantially planar surfaces 15*a*, 15*b*. The first and second surfaces 15*a*, 15*b* are preferably relatively smooth, not necessarily to the microscopic level, but at least to the eye and touch. The smoothness of the first and second surfaces 15*a*, 15*b* helps to limit drag on the rotatable surface 15 as it rotates and thus contributes positively to efficient operation of the vacuum pump.

The central opening 24 of the rotatable surface 15 extends between and through the first and second substantially planar surfaces 15*a*, 15*b*. The central opening 24 is adapted to receive the drive shaft 25 of the drive 16 for rotationally coupling the rotatable surface 15 to the drive 16 which is described further below. The central opening 24 together with the drive shaft 25 defines an axis of rotation of the rotational surface 15.

In one example embodiment of the substantially planar rotatable surface 15, the rotatable surface 15 comprises a substantially circular disk 15, which is best shown in FIGS. 1-8, 12A-12C, and 12G-12J. The disk 15 may be solid, partially solid/partially hollow, or hollow. In this example embodiment, the first and second substantially planar surfaces 15*a*, 15*b* can each extend substantially continuously from the central opening 24 of the disk 15 to the peripheral edge 26*a*. The disk 15 preferably will be as thin as possible without compromising its structural integrity during operation in order to minimize its weight. For the same reason, various slots 30 or other openings may extend through the body of the disk 15 between the first and second substantially planar surfaces 15*a*, 15*b* as best seen in FIGS. 12G-12J. The substantially circular disk embodiment of the rotatable surface 15 with substantially continuous surfaces is particularly suitable for use in the example embodiments of the vacuum pump 10 illustrated in FIGS. 1-4 and similar embodiments wherein the structure of the rotatable surface 15 in whole or in part provides separation between the high pressure portion 12 and the low pressure portion 11 of the vacuum pump 10.

In another example embodiment of the substantially planar rotatable surface 15 as described above, the rotatable surface 15 comprises a substantially circular planar ring which is best shown in FIGS. 12D-12F and 12K-12N. The ring may be solid, partially solid/partially hollow, or hollow and preferably will be as thin as possible without compromising its structural integrity during operation in order to minimize its weight.

In this example embodiment, the outer periphery 26 of the ring is substantially circular. The first substantially planar surface 15*a* comprises a first substantially planar peripheral surface portion 31 and the second substantially planar surface 15*b* comprises a second substantially planar peripheral surface portion 32. The first and second peripheral surface portions 31, 32 are substantially parallel and co-extensive. The first and second peripheral surface portions 31, 32 each extend substantially continuously around the outer periphery 26 of the ring and terminate in the outer peripheral edge 26*a* of the ring. The outer peripheral edge 26*a* may but need not be substantially perpendicular to the first and second peripheral surface portions 31, 32. The first and second peripheral surface portions 31, 32 each extend radially inward from the outer peripheral edge 26*a* for a selected distance and terminate in an inner peripheral edge 33.

The ring has a central hub portion 34 that contains the central opening 24. The central opening 24 extends through the central hub portion 34 and is adapted to receive the drive shaft 25 of the drive 16 as previously noted. The central opening 24 together with the drive shaft 25 defines an axis of rotation of the ring. A plurality of radially spaced apart spokes 35 extend radially outward between the central hub portion 34 and the inner peripheral edge 33 of the first and second peripheral surface portions 31, 32 and rigidly connect the first and second peripheral surface portions 31, 32 to the central hub portion 34. Although the spokes 35 are illustrated as extending linearly and as having square edges, those skilled in the art will appreciate that the spokes 35 can have various shapes including curved, sloped, serpentine, and other shapes consistent with providing a rigid connection, and can have various edge shapes, such as rounded or beveled, for aerodynamic streamlining.

The distance between the outer peripheral edge 26*a* and the inner peripheral edge 33 comprises the width of the first and second peripheral surface portions 31, 32. The distance between the central opening 24 and the outer peripheral edge 26*a* comprises the width (radius) of the ring. Persons skilled in the art will appreciate that the selection of ring width presents a trade-off. Smaller ring widths have less drag at higher pressure values. However, larger ring widths provide more surface area for the impingement of molecules with relatively longer mean free paths at lower pressure values.

Similar considerations apply to the dimensions of the gap 29 between the rotatable surface 15 and the partition 13 in relation to mean free path and pressure, i.e., a larger gap may be suitable for use in relatively higher pressure regimes, whereas for lower pressure regimes a relatively smaller gap may be needed to limit leak-back of gas molecules having relatively high values of mean free path and high velocity. For reasons that will become more apparent from the additional description below and that relate to the surface area present for impingement by gas molecules, the width of the first and second peripheral surface portions 31, 32 is preferably in the range of approximately 0.05 to 0.5 times the width of the radius of the ring 15. This range accommodates use of the vacuum pump 10 with a wide variety of different gases and minimum target pressure values. For a target minimum pressure of about 0.5 atm, the width can be about 0.05 to about 0.2 times the width of the radius. For a target minimum pressure of about $10^{-4}$ atm, the width can be about 0.1 to about 0.3 times the width of the radius. For a target minimum pressure of about 10–6 atm, the width can be greater than about 0.3 times the width of the radius.

Figure 12A:
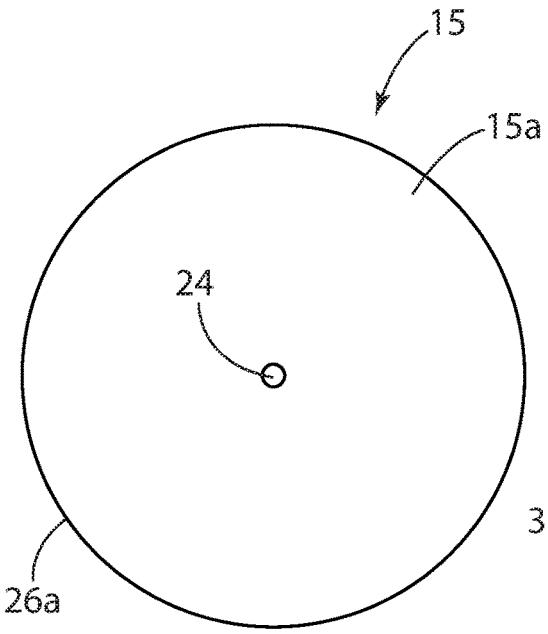
FIG. 12A is a top plan view of one variation of a rotatable disk of a non-sealed single stage vacuum pump with a bladeless gas impingement surface rotatable at supersonic speed according to an example embodiment.
Figure 12D:
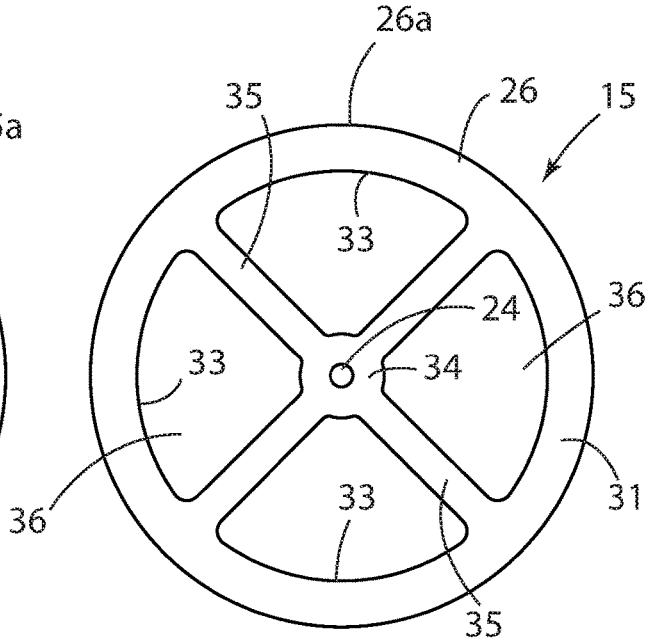
FIG. 12D is a top plan view of one variation of a rotatable ring of a non-sealed vacuum pump with a bladeless gas impingement surface rotatable at supersonic speed according to an example embodiment.
Figure 12B:
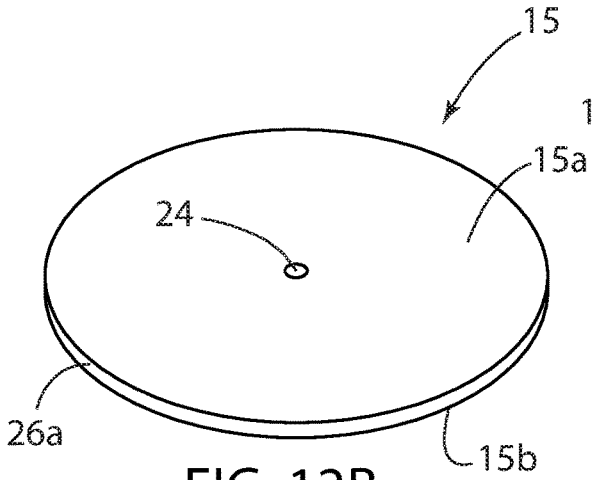
FIG. 12B is a top perspective view of the rotatable disk of FIG. 12A.
Figure 12E:
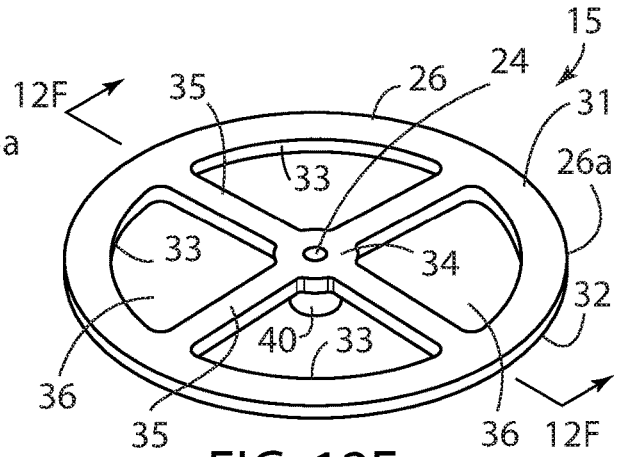
FIG. 12E is a top perspective view of another variation of a rotatable ring of a non-sealed vacuum pump with a bladeless gas impingement surface rotatable at supersonic speed according to an example embodiment.
Figure 12C:
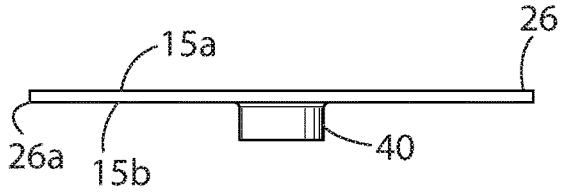
FIG. 12C is a side view of another variation of a rotatable disk of a non-sealed vacuum pump with a bladeless gas impingement surface rotatable at supersonic speed according to an example embodiment.
Figure 12F:
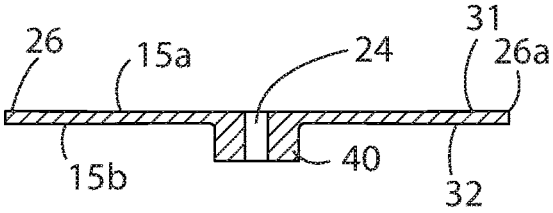
FIG. 12F is a side view of rotatable ring of FIG. 12E.
Figure 12G:
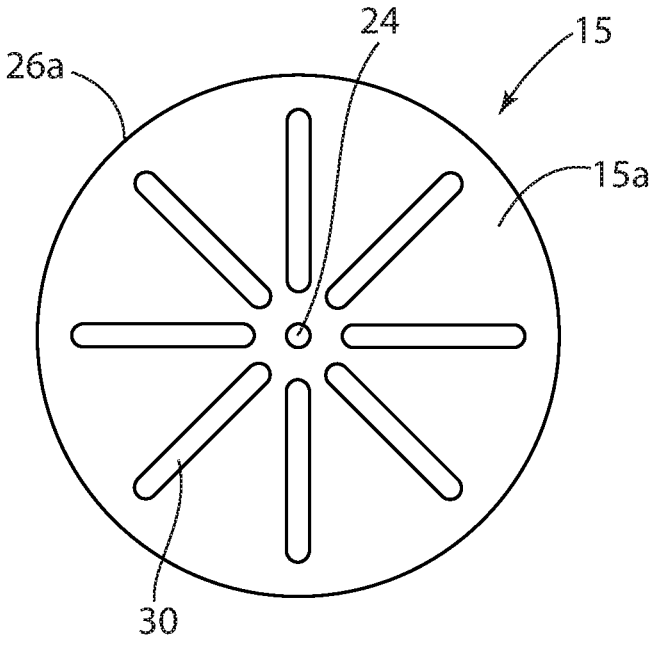
FIG. 12G is a top plan view of yet another variation of a rotatable disk of a non-sealed vacuum pump with a bladeless gas impingement surface rotatable at supersonic speed according to an example embodiment.
Figure 12H:
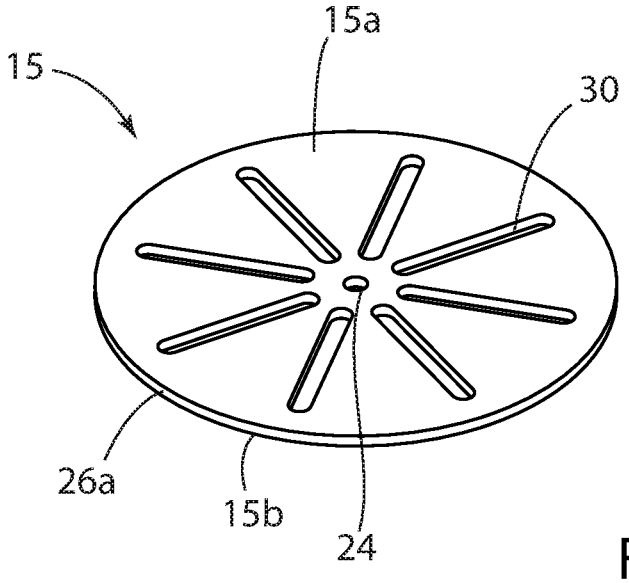
FIG. 12H is a top perspective view of the rotatable disk of FIG. 12G.
Figure 12I:
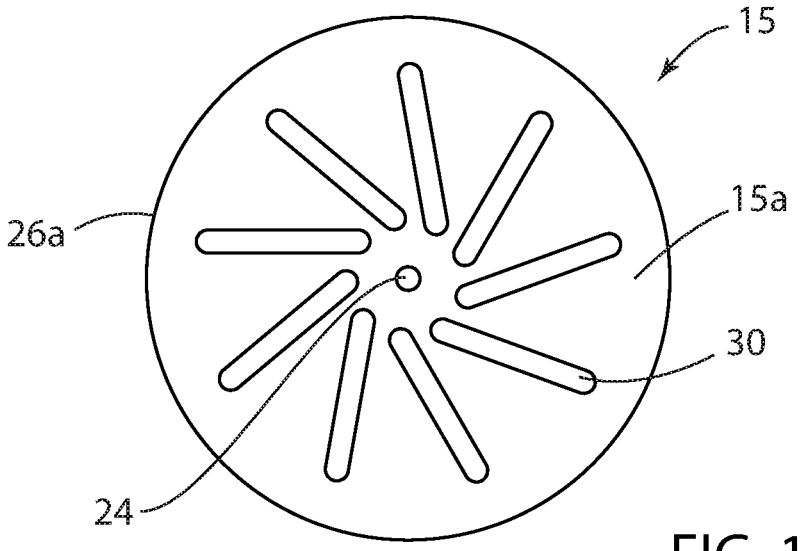
FIG. 12I is a top plan view of still another variation of a rotatable disk of a non-sealed vacuum pump with a bladeless gas impingement surface rotatable at supersonic speed according to an example embodiment.
Figure 12J:
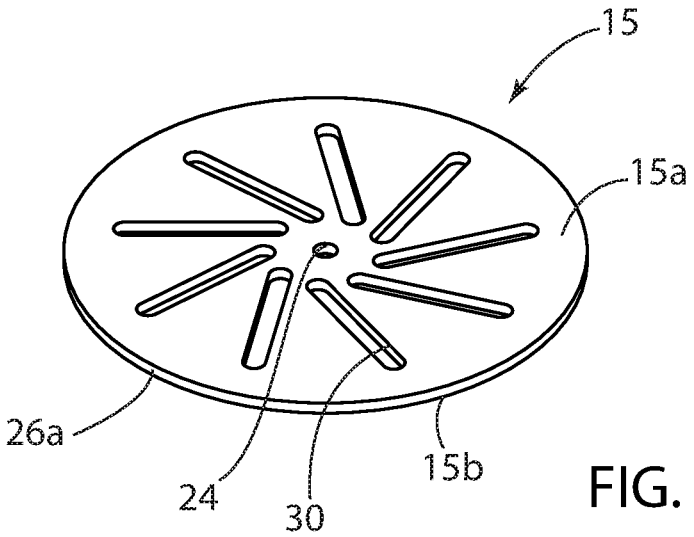
FIG. 12J is a top perspective view of the rotatable disk of FIG. 12I.

Like the example disk embodiment of the rotatable surface 15, the elements of the example ring embodiment of the rotatable surface 15 of FIGS. 12D-12F preferably will be as thin as possible without compromising the structural integrity of the ring 15 during operation in order to minimize weight. In addition, the ring comprises interior portions 36 that are enclosed or bounded by the central hub portion 34, the inner peripheral edge 33 of the first and second peripheral surface portions 31, 32, and adjacent spokes 35. The interior portions 36 have no material and comprise open space, which further reduces the weight of the ring 15. Because of the open spaces, the ring embodiment of the rotatable surface 15 is particularly suitable for use in the example embodiments of the vacuum pump 10 illustrated in FIGS. 5-10 and similar embodiments in which the pressure on the opposite first and second peripheral surface portions 31, 32 (corresponding to the first and second surfaces 15*a*, 15*b* of the rotatable surface 15) can be approximately equal. In other words, the ring embodiment is most suitable for use in embodiments in which the structure comprising the ring is not used or required to provide separation between the high pressure portion 12 and the low pressure portion 11 of the vacuum pump 10.

Regardless of the form of the rotatable surface 15, it is preferred to minimize the weight to the extent possible in order to improve the operational efficiency of the vacuum pump 10. It will be appreciated from the description that follows that the combination of the amount of surface area of the rotatable surface 15 on which the gas molecules can impinge and the tangential velocity of that surface area relative to the most probable velocity of the impinging gas molecules substantially determines the rate and efficiency at which the vacuum pump 10 can reduce the gas pressure in the low pressure portion 11 from a starting or ambient value to a target minimum pressure value. Minimizing the weight of the rotatable surface 15 without substantially reducing the surface area present for impingement enables the drive 16 to more readily and efficiently rotate the rotatable surface 15, especially at higher gas pressures, and to rotate the rotatable surface 15 at greater tangential velocities, both of which enable the vacuum pump 10 to more efficiently and rapidly achieve target minimum pressure values.

Figure 9:
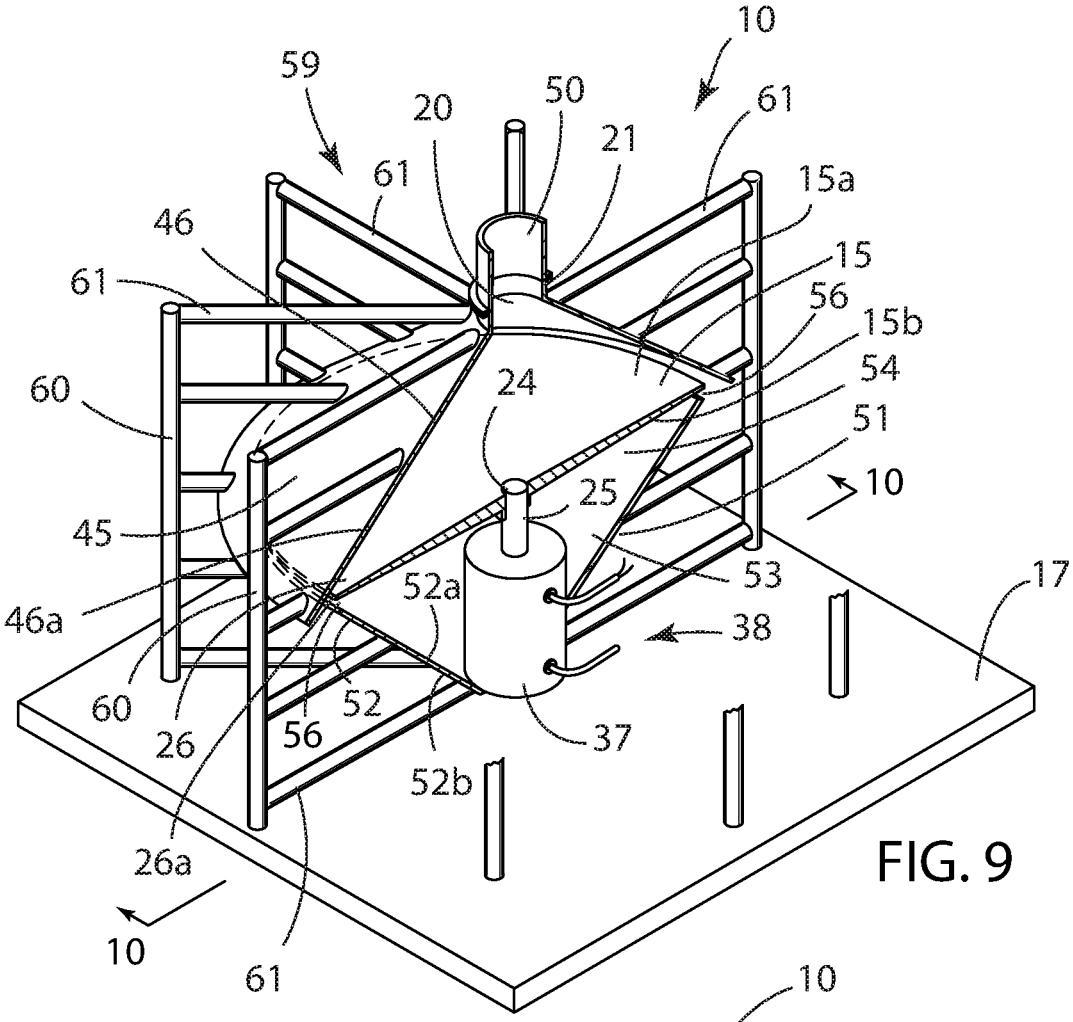
FIG. 9 is a top perspective view partially in cross section and partially transparent of a non-sealed vacuum pump with a bladeless gas impingement surface rotatable at supersonic speed and an open frame according to still another example embodiment.
Figure 10:
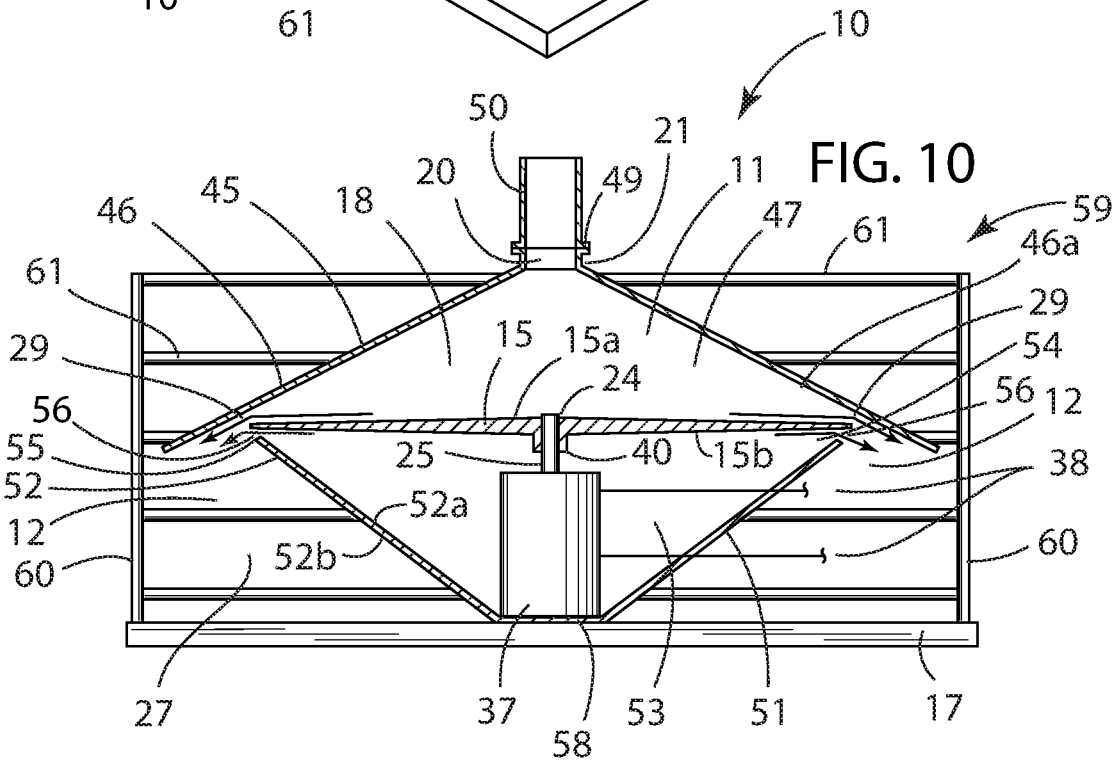
FIG. 10 is a cross-sectional view of the non-sealed vacuum pump with a bladeless gas impingement surface rotatable at supersonic speed with an open frame of FIG. 9.

In yet another example embodiment of the rotatable surface 15 best seen in FIGS. 9-10, the rotatable surface 15 may have a non-uniform thickness dimension gradient between the central opening 24 and the outer peripheral edge 26*a*. The thickness dimension may vary continuously or discretely. In one version, the thickness dimension may vary substantially continuously so that the first surface 15*a*, the first peripheral surface portion 31, the second surface 15*b*, the second peripheral surface portion 32, or any combination of them have a taper as they extend outwardly away from the central portion 23, central opening 24, and/or central hub portion 34 toward the outer periphery 26. The taper is preferably but not necessarily substantially continuous and linear. A non-uniform thickness gradient can help maintain the strength and rigidity of the rotatable surface 15 at and near its axis of rotation while reducing weight and potential drag near the outer periphery 26 where the rotatable surface is intended to rotate with very high rates of tangential velocity in the supersonic range.

The rotatable surface 15 may have a maximum thickness dimension at or near the central opening 24 which decreases to a minimum thickness dimension at or near the peripheral edge 26*a*. With this configuration, the first and second surfaces 15*a*, 15*b* will remain almost but not quite parallel with each other as they slope outwardly at an angle from the central opening 24 to the peripheral edge 26*a*. Also in this configuration, when the rotatable surface 15 is positioned in the high pressure portion 12 in relation to the partition 13, gas flow path 14, and openings 22 as described above, the first surface 15*a* will extend almost but not quite parallel with the surface 13*a* of the partition 13 that is exposed to the high pressure portion 12.

Configuring the rotatable surface 15 to be hollow or partially-hollow can remove additional weight. Either embodiment of the rotatable surface 15, e.g., circular disk and ring, may be constructed in this way. The materials used to construct the rotatable surface 15 can be selected to maintain the structural integrity, strength, and stiffness of the rotatable surface 15. Additional measures also may be taken to ensure structural integrity, strength, and stiffness. Internal supports may be provided in the hollow space between the first and second surfaces 15*a*, 15*b* and/or the first and second peripheral surface portions 31, 32, and may extend internally between the first and second surfaces 15*a*, 15*b* and/or the first and second peripheral surface portions 31, 32 to provide support and help maintain rigidity of the rotatable surface 15. If the spokes 35 also are hollow or partially-hollow, internal supports can also be provided internally in the spokes 35. The internal supports may comprise for example one or more discrete structures, such as pillars or posts, and/or one or more continuous structures, such as short circumferentially-extending cylinders, or short radially-extending fins or walls. If the thickness dimension of a hollow or partially-hollow rotatable surface 15 is substantially uniform as it will be when the rotatable surface 15 is substantially planar as described above, the internal supports also can be of substantially uniform dimension. If the thickness dimension of the rotatable surface 15 varies, as will when the rotatable surface 15 is tapered as described above, the internal supports will have dimensions that vary or taper accordingly.

It should be noted that while the several example embodiments of the rotatable surface 15 described above all have an outer periphery 26 that is substantially circular-shaped, other peripheral shapes may be used if desired.

The rotatable surface 15 may be constructed as a single monolithic structure or as a composite or assembly of components. The rotatable surface 15 may be constructed using suitable machining, molding, solid printing or other techniques. It is preferred that the rotatable surface 15 be constructed of materials that are light in weight, rigid, have relatively high tensile and breaking strengths, and have high resistance to thermal stress. These characteristics are preferred for the rotatable surface 15 to withstand the substantial forces and heat that may be generated when the rotatable surface 15 is rotated at the very high rates of rotational and tangential velocity described herein without damage. Various materials and constructs already in use for very high speed rotational machinery are suitable. For example, various materials presently used for very high rotational velocity turbines and certain existing vacuum pumps, such as turbo-molecular pumps, are suitable. Suitable materials may include but are not limited to various titanium alloys, magnesium alloys, aluminum alloys, carbon fiber and carbon fiber composites, fiberglass and fiberglass composites, carbon graphite, Kevlar®, and various composites and combinations of the foregoing.

In addition, it is preferred that the rotatable surface 15 (and any other components of the vacuum pump 10) that may cause or be subject to vibration be precision-balanced and suitably dampened to minimize the vibrations and the effects of such vibrations that may occur when the rotatable surface is rotated at the very high rates of rotational velocity described herein. Precision-balancing and vibration damping elements and techniques already in use in connection with existing very high rotational velocity machinery such as high rotational velocity turbines, hard disks, computer numerical control (CNC) cutting machines, and certain existing vacuum pumps, such as turbo-molecular pumps, are suitable for that purpose.

The rotatable surface 15 is adapted to be rotatable in a plane of rotation and around an axis of rotation. Accordingly, the first surface 15*a* and the second surface 15*b* of the rotatable surface 15 are adapted to be rotatable in the plane of rotation around the axis of rotation. Preferably, but not necessarily, the plane of rotation is substantially perpendicular to the axis of rotation. In the example embodiments as illustrated in FIGS. 1-2 and described above, the rotatable surface 15 and more specifically the first surface 15*a* of the rotatable surface 15 is preferably positioned in the high pressure portion 12 adjacent to, in close proximity to, and facing the surface 13*a* of the partition exposed to the high pressure portion 12 and the openings 22 in the partition 13. In this position, the plane of rotation of the rotatable surface 15 and more specifically the first surface 15*a* is substantially parallel to the surface 13*a* of the partition 13 and is substantially perpendicular to (or at one or more selected angles to) the axis of the gas flow path 14 and/or the openings 22.

Generally speaking, as the first surface 15*a* of the rotatable surface 15 rotates in the plane of rotation, each point or location on the first surface 15*a* has a tangential velocity and a related centrifugal force associated with it. As gas molecules entering the high pressure portion 12 through the openings 22 in the partition 13 impinge on the first surface 15*a* at various points or locations, the tangential velocity and centrifugal force associated with those points or locations are transferred to the impinging gas molecules. If the tangential velocity and centrifugal force are sufficiently great, they can overcome the directional force of the impinging molecules, redirect the impinging molecules toward the periphery 26 of the first surface 15*a*, and ultimately eject the impinging molecules at the vectoral combination of the reflected incoming velocity and the tangential velocity of direction and speed of the rotatable surface 15 outwardly from the periphery 26 into the high pressure portion 12, where they can be ultimately directed toward a gas outlet. If a sufficient number of impinging molecules are ejected outwardly from the periphery 26 at a sufficient rate, then a net outward flow of gas molecules from the low pressure portion 11 to the high pressure portion 12 is generated as indicated by the arrows in FIGS. 2, 4-8 and others. The outward flow of gas molecules is at least partially guided by the surface 13*a* of the partition 13 that is adjacent to the first surface 15*a* of the rotatable surface 15.

In order to redirect a sufficient volume of impinging molecules at a sufficient rate to generate a substantial net outflow of gas over a wide range of pressure conditions, the present inventor has discovered to rotate the rotatable surface 15 and more specifically the first surface 15*a* at very high rates of rotational and tangential velocity heretofore not envisioned by practitioners in the art. More specifically, the inventor has discovered to rotate the rotatable surface 15 and more specifically the first surface 15*a* at a rate of rotational velocity sufficient to impart to at least a portion of the rotatable surface 15 and more specifically the first surface 15*a* an associated tangential velocity that is multiple times the most probable velocity of the gas molecules impinging on the rotatable surface 15 and more specifically the first surface 15*a*. Even more specifically, the present inventor has discovered to rotate the rotatable surface 15 and more specifically the first surface 15*a* with a rotational velocity such that at least a portion of the rotatable surface 15 and more specifically the first surface 15*a* rotates with a tangential velocity that is preferably in a range of approximately 1-6 times the most probably velocity of the impinging gas molecules according to the Maxwell-Boltzmann velocity distribution for the impinging gas molecules. Using air molecules at 20° C. at 1 atm as an example representative gas with which the vacuum pump 10 is intended to be used, the most probable velocity is approximately 410 m/sec, and the speed of sound in dry air at 1 atm and 20° C. is approximately 343 m/sec. This equates to a range of tangential velocities that are generally supersonic and in a range from approximately 1.2 to 7.2 times the speed of sound (approximately Mach 1.2 to Mach 7.2). Operating with at least a portion of the rotatable surface 15 rotating within the preferred range of tangential velocities, the example embodiments of the vacuum pump 10 can provide excellent pumping results with a wide variety of different gases and over a wide range of pressures and temperatures without the need to employ multiple pumps or pumping stages.

The present inventor has further discovered that when rotated with sufficient rotational velocity to produce tangential velocity values in the described preferred range, the rotatable surface 15 and more specifically the first surface 15*a* impart sufficient outward tangential momentums to a sufficient number of impinging gas molecules at a sufficient rate to establish a substantial rate and volume of net outward flow of gas from the periphery 26 of the rotatable surface 15 and more specifically the first surface 15*a* from the low pressure portion 11 into the high pressure portion 12 and does so without needing to use seals to prevent gas leaking back to the low pressure portion 11. Further, the impinging gas molecules that exit the low pressure portion 11 into the high pressure portion 12 and impinge on the first surface 15*a* are ejected outwardly from the first surface 15*a* at a rate and volume that substantially exceeds the rate at which gas molecules in the low pressure portion 11 can be replenished by returning slower velocity molecules. Accordingly, when constructed and operated as described, the example embodiments of the vacuum pump 10 are able to rapidly and efficiently lower or reduce the pressure in the low pressure portion 11 from a starting or ambient pressure to a target minimum pressure value.

The present inventor has also discovered that when constructed and operated as described, the example embodiments of the vacuum pump 10 are able to rapidly and efficiently reduce the pressure in the low pressure portion 11 from a starting or ambient pressure to a target minimum pressure over a wide range using a single pump and in a single pumping stage without the need to use multiple different pumps and/or multiple pumping stages as is typically required with conventional vacuum pumps. For example, the inventor has discovered that an example embodiment of the vacuum pump 10 constructed and operated as described can rapidly and efficiently reduce the pressure in the low pressure portion 11 from a starting or ambient pressure of approximately 1 atm to a target minimum pressure of 0.5 atm, for general roughing vacuum applications, and even to the mid-high vacuum range, e.g., $10^{-4}$-$10^{-6}$ atm in a single stage using the same pump. Still further, and as described above, the present inventor has discovered that when constructed and operated as described, the example embodiments of the vacuum pump 10 can reduce the pressure in the low pressure portion 11 down to the indicated target minimum pressure value ranges without the need to use seals to prevent the gas from leaking back from the high pressure portion 12 to the low pressure portion 11 through the gas flow path 14.

As will be appreciated, it is a unique characteristic of the example embodiments described herein that the rotatable surface 15 and more specifically the first and second surfaces of the rotatable surface 15*a*, 15*b* are substantially smooth and preferably planar surfaces with no outwardly extending blades, vanes, impellers, or other protrusions or features. In addition, the rotatable surface 15 is not itself arranged or configured as a blade or impeller like the angled or curved sets of blades found in conventional turbo-molecular and other conventional vacuum pumps. Such blades and/or vanes are a major source of drag especially at higher gas pressures and are a substantial reason why multiple pump stages using different types of pumps are generally required to pump down from approximately atmospheric ambient or starting pressure to target minimum pressure values in the high to mid-vacuum range, i.e., $10^{-4}$ to $10^{-6}$ atm, or below.

It is a fundamental difference between the example embodiments of the vacuum pump 10 described herein and conventional turbo-molecular pumps that in the latter sets of blades or vanes are intentionally rotated through a gas to actively contact the gas molecules and physically push them ahead of the blades or vanes, and are actually arranged at an angle to increase the cross-sectional area of contact in order to actively impact more molecules. The gas molecules are successively pushed from one set of blades or vanes at one level/story to another set of blades or vane at another level/story, with each successive set of blades or vanes being arranged at a different angle in order to rotate at higher speed and further compress the gas to higher pressures in multiple levels/stories. The action by the angled blades to push the molecules in one direction also creates a reaction force in the opposite direction, and the reaction force exerts a load against rotation of the blades or vanes particularly at higher pressure operation. Such an arrangement is also subject to substantial drag effects especially at higher starting or ambient pressures. Accordingly, such pumps are not suitable or even capable to pump down from relatively higher pressures such as atmospheric pressure to near vacuum pressure levels, e.g., $10^{-4}$-$10^{-6}$ atm alone and without the use of multiple pump stages, for example foreline and backing pumps. In contrast, the rotatable surface 15 of the example embodiments is not angled or otherwise arranged to actively contact gas molecules as it rotates. Rather, the rotatable surface 15 of the example embodiments operates in a passive sense in that is impinged on by gas molecules. It does not create the action and reaction forces or the load against rotation that the angled blades create. Further, whether the rotatable surface 15 is impinged on by gas molecules depends on the natural (random) direction of the gas molecules velocity distribution, not on the direction or angle of rotation of the rotatable surface 15 relative to the gas molecules. Still further, the rotatable surface 15 of the example embodiments is arranged in a way to minimize drag rather than maximize it.

Contrary to the conventional mechanical pump designs such as molecular drag pumps, turbo molecular pumps, vane pumps, dry pump, screw pumps, roots blowers, piston and diaphragm pumps, all of which are designed with components that actively drag and push molecules, the present invention does the opposite by trying to construct all rotating components, e.g., rotatable surface 15 (rotatable disk or spoked ring), to have aerodynamically streamlined profiles and to minimize drag. The fundamental difference of this invention is that the moving surfaces, e.g., rotatable surface 15, passively await impingement by the randomly free moving molecules and eject them upon impact. For each impinging impact, a molecule collides with a few closely-spaced surface-bounded solid atoms of the surface 15*a* or 15*b* of the rotatable surface 15 and experiences a recoil reaction at the atomic monolayer level. The surface atoms transfer their rotating velocity to the outgoing molecule upon the impact. At a given pressure, the total number of molecules that impinge on the rotatable surface 15 is a multiple of the surface impingement rate with the projected surface area of the physical surface 15*a*, 15*b* and is independent of whether the surface is moving or stationary. Another aspect is that even at atmospheric pressure (atm), for example, the mean free paths of air molecules is $6.58\times10^{-6}$ cm, which is two orders of magnitude larger than the solid lattice spacing between atoms on the surfaces 15*a*, 15*b* of the rotatable surface 15, which is about 0.2 nm. Therefore, independent of whether the topologies of the surfaces 15*a*, 15*b* are macroscopically rough or microscopically smooth, the projected surface area that an impinged molecule essentially "sees" is the same. Each impinging molecule receives a tangential moving velocity (from the point of impact with the surface 15*a* or 15*b*) that is 1 to 6 times the most probable velocity of the molecules, which either adds to or subtracts from the original speed and changes the direction of the impinging molecule. The resulting outgoing angle of the impinging molecule is substantially a grazing angle with respect to the plane of rotation of the rotatable surface 15 and the direction of the impinging molecule is in a direction tangential to the rotational velocity of the surface. Thus, when a substantially planar surface with no protrusions or other outwardly extending features, such as the surfaces 15*a*, 15*b* of the rotatable surface 15, rotate in a plane of rotation substantially perpendicular with respect to the axis of rotation, impinging molecules impinge only on the projected physical area of the surface depending on the random directions of the molecules themselves. However, when a rotating surface has an angle that is not perpendicular with respect to the plane and axis of rotation, or has protrusions or other features that extend outwardly from the plane of rotation, such as the angled blades of a turbine, some molecules will naturally impinge on the projected physical surface area of the blades based on the random directions of motion of the molecules, but in addition many molecules which are not moving in a direction to naturally impinge on the projected area are also actively impacted by the sweeping angled blades as they rotate and intercept the paths of motion of the otherwise non-impinging molecules. Therefore, greater numbers of molecules are impacted by the angled turbine blades as compared to the same total physical area of the non-angled substantially planar physical surface area of the surfaces 15*a*, 15*b* of the rotational surface 15. The result is that any rotating protruded or angled surfaces, blades, impeller and vanes will encounter more impacts, more momentum transfers to molecules, and thus more drag and more power consumption as compared to a substantially planar, non-angled and featureless surface rotating in a plane substantially perpendicular to the axis of rotation. Accordingly, the substantially planar and featureless rotating surface, such as the surfaces 15*a*, 15*b* of the rotatable surface 15, thus intrinsically encounter less drag. The present invention is thus characterized in part by minimizing the drag encountered by the surface area present for impingement for a desired pumping speed and within the power and torque that a drive can provide while optimizing the number of molecules being ejected outwardly from impinging on the rotating surface area.

The drive 16 may comprise a drive motor 37 and the drive shaft 25. The drive motor 37 operates to rotationally drive the drive shaft 25. The drive motor 37 and drive shaft 25 may be arranged so that the drive motor 37 directly or indirectly rotationally drives the drive shaft 25. The drive motor 37 may be positioned in the region or space 27 of the high pressure portion 12 of the vacuum pump 10 or external to the high pressure portion 12. The drive motor 37 may be removably or permanently mounted using suitable mounts and connectors to a component of the vacuum pump 10, such as the base 17, or to a surface or structure separate from and exterior to the vacuum pump 10. Suitable electrical lines, cooling feed and return lines and conduits, etc. 38 may be connected to the drive 16 directly or indirectly. If the drive 16 is partially or completely enclosed within the region or space 27 of the high pressure portion 11 by an inner enclosure 51, which is described below, the electrical or other feed lines 38 can be fed through a wall or walls 52 of the inner enclosure 51 via one or more suitably vacuum sealed feed-throughs or passages. Similarly, if the drive is located externally to the high pressure portion 12 but the drive shaft 25 extends into an inner enclosure 51 within the high pressure portion 12, the drive shaft 25 can pass through a wall 52 of the inner enclosure 51 via a suitably sealed bearing or the like.

In an arrangement wherein the drive motor 37 directly drives the drive shaft 25, the drive shaft 25 may comprise the rotor of the drive motor 37 or may be directly coupled to the rotor. In that arrangement, the drive shaft 25 extends outwardly from the drive motor 37 and is rotatable with respect to the drive motor 37. In an arrangement wherein the drive motor 37 indirectly drives the drive shaft 25, a set or series of gears, belts, pulleys or other apparatus may be employed between the drive motor 37 and the drive shaft 25 to transfer the rotational motion of the rotor of the drive motor 37 to the drive shaft 25. The drive shaft 25 may be coupled to the vacuum pump 10 and rotatably supported with respect to vacuum pump 10 by suitable bearings or the like.

The drive 16 and more specifically the drive motor 37 is rotatably coupled to the rotatable surface 15 through the rotatable drive shaft 25 and a coupler 40. The drive shaft 25 is received in the central opening 24 of the rotatable surface 15. As described above, the central opening 24 together with the drive shaft 25 defines the axis of rotation of the rotatable surface 15. Also as described above, the drive shaft 25 is preferably but not necessarily coupled to the rotatable surface 15 such that the plane of rotation of the rotatable surface 15 is substantially perpendicular to the axis of rotation. The drive shaft 25 is preferably removably but fixedly coupled to the rotatable surface 15 at the central opening 24 by the coupler 40 so that the rotation of the drive shaft 25 is transferred to the rotatable surface 15 and the rotatable surface 15 rotates with the drive shaft 25. The coupler 40 may be any suitable high rotational speed coupler. The coupler 40 may comprise a flexible or rigid coupler and may comprise a vibration damping element. The coupler 40 may be a separate component or may be part of the rotatable surface 15 or part of the drive shaft 25. Preferably, the coupler 40 is sufficiently strong to withstand the values of torque that may arise as the drive shaft 25 imparts rotational motion to the rotatable surface 15 over at least the range of rotational velocity values and the range of pressure values described herein without slippage or damage. In an example embodiment, the coupler 40 can comprise one or more threaded nuts and the drive shaft 25 can be threaded so that the coupler and drive shaft can be threadedly engaged. The coupler 40 also preferably serves as a substantially gas impermeable barrier such that no gas can pass or leak-back through it from the high pressure portion 12 to the low pressure portion 11.

The drive motor 37 may be any type of drive motor that is capable of rotating the rotatable surface 15 over a range of rotational velocities sufficient to cause at least a portion of the rotatable surface 15 to rotate with a tangential velocity in the range of approximately 1-6 times the most probable velocity of the gas molecules impinging on the rotatable surface 15. As described briefly above and in more detail below, depending on the gas to be pumped this generally equates to a tangential velocity in the supersonic range of about 1.2 to about 7.2 times the speed of sound (approximately Mach 1.2 to Mach 7.2). The drive motor 37 may comprise a suitable electric motor drive, such as an AC, DC, or induction motor, or a suitable magnetic drive. For example, the drive motor 37 may suitably comprise a drive motor of the same type as the high rotational speed and high torque motors used as spindle motors in computer numerical control (CNC) machines, or a drive motor of the same type used in connection with conventional high rotational speed turbo-molecular vacuum pumps. Various CNC spindle drive motors are available commercially at various ratings including 2.2 kW, 24000 rpm; 9.5 kW, 24000 rpm; 13.5 kW, 18000 rpm; 20 kW, 24000 rpm; and 37 kW, 20000 rpm, and are suitable to drive rotatable disks of aluminum, carbon fiber, and other materials with diameters of 12, 24, 36, 47 inches and even larger diameters in the ranges of rotational and tangential velocity described herein.

As described above, the drive motor 37 may be but need not necessarily be capable of directly driving the drive shaft 25 with sufficient rotational velocity to generate tangential velocities in the described preferred range. Conventional gears, pulleys, or the like can be used between drive motor 37 and the drive shaft 25 to increase the rotational velocity of the drive shaft 25 as necessary to achieve tangential velocities in the preferred range. It is also contemplated that the drive motor 37 can be off-axis and drive the rotatable surface 15 not by a center drive shaft 25 but with a drive member that is near, next to, or within the inner or outer peripheral edges 26*a*, 33 or on top or below the first and second surfaces 15*a*, 15*b* or the first and second peripheral surface portions 31, 32 of the rotatable surface 15 via suitable rotational transmission mechanism couplings. It is also contemplated that the rotatable surface 15 can be constructed as a magnetic levitation ring and part of the driving motor 37 components.

Before proceeding further, it is noted and will be understood that the example embodiments of the vacuum pump 10 may be constructed, installed, and operated essentially without regard to orientation and this applies to all example embodiments described herein. Thus, for example, the embodiments illustrated in FIGS. 1-10 are shown in an "upright" or "vertical" orientation with the low pressure portion 11 vertically above the high pressure portion 12 and the partition 13 and rotatable surface 15 extending laterally below the low pressure portion 11. However, the vacuum pump 10 may be oriented with a "side" or "lateral" orientation wherein the low pressure and high pressure portions 11, 12 are side by side with the partition 13 and rotatable surface 15 extending vertically adjacent to the low pressure portion 11, or in a "flipped vertical" orientation wherein the high pressure portion 12 is vertically above the low pressure portion 11 with the partition 13 and rotatable surface 15 extending laterally beneath the high pressure portion 12, or in any other orientation in between. It is further understood that when gas inlets and outlets are included, they also can be positioned at various locations and with various orientations.

As described above, the rotatable surface 15 is adapted to be rotatable in a plane of rotation and around an axis of rotation with at least a portion of the rotatable surface 15 preferably being rotatable at a very high rate of tangential velocity in the range of approximately 1 to 6 times the most probable velocity of the gas molecules impinging on the rotatable surface 15. The basis for this is described in further detail below.

The most probable velocity of the gas molecules can be derived from the Maxwell-Boltzmann distribution function and can be expressed as follows:

$$v_m = \sqrt{\frac{2kT}{m}} \qquad [m/\text{sec}] \tag{1}$$

where m is molecular mass, which is $m=M/N_{AV}$ and $N_{AV}$ is Avogadro's number, M is the molar mass of the molecular mass per mole, k is the Boltzmann constant, and T is temperature.

The most probable velocity represents the peak of the Maxwell-Boltzmann distribution curve and indicates that of the total number of gas molecules in the given volume the greatest number of molecules are most likely to have the velocity $v_m$. For example, at 1 atm and 20° C., the $v_m$ in dry air is 410 m/sec and in nitrogen ($N_2$) is 417 m/sec. In contrast, the speed of sound in dry air at 1 atm and 20° C. is approximately 343 m/sec. Therefore, the $v_m$ in dry air at 1 atm and 20° C. approximately 1.2 times the speed of sound or Mach 1.2. In other words, the most probable velocity $v_m$ in either dry air or nitrogen under these conditions is supersonic.

It should be noted that the most probable velocity $v_m$ only depends on T/m. Accordingly, different gas molecules or mixtures of molecules of different mass m will have different most probable velocities $v_m$ at the same temperature. Also, where there are statistically enough molecules, the velocities are independent of the number of molecules N, the volume size V, and the molecular volume density n with n=N/V.

The gas molecules in a given volume of space at a given pressure (P) also exhibit a mean free path (λ) or average distance between collisions. The pressure P and the mean free path A are inversely proportional and Pλ=C*, where C* is a gas molecular property parameter which characterizes the molecular cross-section and mass, and is temperature dependent. The value of C* for various different gases can be obtained from various sources, including the Fundamentals of Vacuum Technology, published by Leybold Vacuum. The value of C* at 20° C. as reported in Table III of the foregoing reference for various gases with which the example embodiments of the vacuum pump 10 may be used is as follows:

TABLE 1

| Gas at 20° C. | | C* = λP [cm · mbar] |
|---|---|---|
| $H_2$ | Hydrogen | $12.00 \times 10^{-3}$ |
| He | Helium | $18.00 \times 10^{-3}$ |
| Ne | Neon | $12.30 \times 10^{-3}$ |
| Ar | Argon | $6.40 \times 10^{-x3}$ |
| Kr | Krypton | $4.80 \times 10^{-3}$ |
| Xe | Xenon | $3.60 \times 10^{-3}$ |
| Hg | Mercury | $3.05 \times 10^{-3}$ |
| $O_2$ | Oxygen | $6.50 \times 10^{-3}$ |
| $N_2$ | Nitrogen | $6.10 \times 10^{-3}$ |
| HCl | Hydrochloric acid | $4.35 \times 10^{-3}$ |
| $CO_2$ | Carbon dioxide | $3.95 \times 10^{-3}$ |
| $H_2O$ | Water vapor | $3.95 \times 10^{-3}$ |
| NH3 | Ammonia | $4.60 \times 10^{-3}$ |
| $C_2H_5OH$ | Ethyl alcohol | $2.10 \times 10^{-3}$ |
| $Cl_2$ | Chlorine | $3.05 \times 10^{-3}$ |
| Air | Air | $6.67 \times 10^{-3}$ |

The well-known ideal gas equation is:

$$P = nkT = \frac{N}{V}kT \tag{2}$$

where n is the particle density of the total number molecules N within the volume V.

For a surface within a volume, the gas molecules also exhibit a surface impingement rate ($Z_A$) indicating the number of molecules that impinge on a unit area ($cm^2$) of the surface per second. The impingement rate $Z_A$ is also given by the previous reference of the equation:

$$Z_A = \sqrt{\frac{NAV}{2\pi MkT}}\,P = 2.63\times10^{22}\frac{P}{\sqrt{MT}} = 2.85\times10^{20}P[\text{cm}^{-2}\text{sec}^{-1}]. \tag{3}$$

Similarly, the volume collision rate ($Z_V$), i.e., the collision frequency of gas molecules with other gas molecules in a unit volume ($cm^3$) per second, varies with the pressure $P^2$ according to the relationship expressed as follows:

$$Z_V = \frac{1}{C*}\sqrt{\frac{2NAV}{\pi MkT}}\,P^2 = 5.27\times10^{22}P^2\frac{1}{C*\sqrt{MT}} = 8.6\times10^{22}P^2[\text{cm}^{-3}\text{sec}^{-1}]. \tag{4}$$

It is noted that the foregoing solutions of Equations 3 and 4, i.e., $Z_A=2.85\times10^{20}$ P and $Z_V=8.6\times10^{22}$ $P^2$, are specific for air molecules at 20° C. and P is measured in units of mbar, and other gas molecules and other conditions will produce different solutions.

From the foregoing, it is apparent that as the number of gas molecules, e.g., air molecules, in a given volume of space decreases and the pressure P accordingly decreases, the mean free path λ of the remaining air molecules increases and both the surface impingement rate $Z_A$ and volume collision rate $Z_V$ decrease. The same relationship applies to other gas molecules in the same way, although the values of mean free path λ, surface impingement rate $Z_A$, and volume collision rate $Z_V$ will be different from air and may be greater or less at the same pressure values. As indicated in Table 1, generally larger gas molecules, e.g., chlorine ($Cl_2$), will exhibit proportionally lower values of mean free path λ at the same temperature over the same range of pressure values, e.g., approx. 3.05 cm for $Cl_2$ at $10^{-3}$ mbar to 6.67 cm for air at $10^{-3}$ mbar, while smaller gas molecules, e.g., helium (He), will exhibit proportionally higher values of mean free path, e.g., approx. 18 cm at $10^{-3}$ mbar.

Gas molecules in a given volume of space under given conditions of temperature and pressure move randomly in all directions and with different velocities (v). The Maxwell-Boltzmann distribution function can be used to determine the distribution of the velocities (v) of the gas molecules under such conditions. One way the Maxwell-Boltzmann distribution function may be expressed can be found from the college textbook Statistical Thermodynamics, by John F Lee; Francis Weston Sears: Donald L Turcotte, Addison-Wesley, 1963 and is as follows:

$$N_{0\to x} = N\left[erf(x) - \frac{2}{\sqrt{\pi}}xe^{-x^2}\right] \tag{5}$$

where $x=v/v_m$ is a velocity ratio and $v_m$ is the most probable velocity, N is the total number of molecules in a given volume, and $N_{0\to x}$ is the number of molecules having velocity from 0 to v. The erf(x) is the error function of x. And the complementary equation to equation (5) is:

$$N_{x\to\infty} = N - N_{0\to x} = N\left[1 - erf(x) + \frac{2}{\sqrt{\pi}}xe^{-x^2}\right] \tag{6}$$

where $N_{x\to\infty}$ is the number of molecules having velocity from v to ∞.

From the foregoing, it is apparent that when molecules within the given volume are continuously being ejected from the volume at a velocity (v), then only those molecules outside the volume with velocity v→∞ have a chance to return to within the volume. Therefore, the number of molecules that ultimately can remain inside the volume is the number of returning molecules of velocity v→∞ as stated by Equation (6).

In a given volume, the portion of the pressure attributable to a given number of molecules N that is less than the entire number of molecules in the volume is directly proportional to the fraction the given number of molecules N represents to the total number of molecules. Thus, the pressure for a number of molecules N in a given volume is directly proportional to the fraction of the given number of molecules to the total number of molecules within the volume. For example, assuming N molecules in a given volume at 1 atm, the pressure attributable to all molecules in the volume is represented by the fraction N/N=1 and therefore the fraction of the pressure exerted by all molecules is 1, or the initial pressure, 1 atm. Similarly, the pressure attributable to the fraction of the molecules having velocity 0→v is:

$$N_{0\to x}/N = erf(x) - \frac{2}{\sqrt{\pi}}xe^{-x^2} \tag{7}$$

and the pressure attributable to the fraction of the molecules having velocity v→∞ is:

$$N_{x\to\infty}/N = 1 - erf(x) + \frac{2}{\sqrt{\pi}}xe^{-x^2} \tag{8}$$

Since the pressure within a given volume attributable to a number of molecules N is directly proportional to the fraction that number of molecules represents to the total number of molecules in the volume, Equations 7 and 8 thus also represent the partial pressure within the given volume attributable to molecules having velocities 0→v and v→∞ respectively. The case where v=0 and thus x=0 accounts for all molecules having all velocities in the volume. In this particular case, the fraction of molecules with respect to all molecules is 1 and the pressure in the volume is the initial pressure of 1 atm. Similarly, equations 5-8 represent numerical values which only depend on the ratio of $x=v/v_m$ where v represents molecular velocity and $v_m$ represents the most probable velocity. Further, the ratio x only depends on the gas molecular mass and temperature encompassed in the ratio x via $v_m$. For any gas, at any ordinary temperature range, and with the same velocity ratio x, the results of equations 5-8 are universal within the assumptions for ideal gases and the Maxwell-Boltzmann distribution function. Based on equations 5-8, Table 2 illustrates the lowest residual pressures that can be theoretically achieved in a given volume for various ratios of x and molecular velocity $v=xv_m$.

TABLE 2

| $N_{x\to\infty}/N = 1 - erf(x) + \frac{2}{\sqrt{\pi}}xe^{-x^2}$ | | | Air at 20° C. | | |
|---|---|---|---|---|---|
| $x = v/v_m$ | Fraction of Molecules and Pressure P [atm] | Pressure P [mbar] | Mean Free Path λ [cm] | Surface ImpingeRate $Z_A$ [#/cm$^2$ − sec] | Volume Collision Rate $Z_V$ [#/cm$^3$ − sec] |
| 0 | 1 | 1013 | $6.58 \times 10^{-6}$ | $2.89 \times 10^{23}$ | $8.83 \times 10^{28}$ |
| 0.5 | 0.919 | 931 | $7.16 \times 10^{-6}$ | $2.65 \times 10^{23}$ | $7.45 \times 10^{28}$ |
| 1 | 0.572 | 579 | $1.15 \times 10^{-5}$ | $1.65 \times 10^{23}$ | $2.88 \times 10^{28}$ |

TABLE 2-continued

| $N_{x\to\infty}/N = 1 - erf(x) + \frac{2}{\sqrt{\pi}}xe^{-x^2}$ | | | Air at 20° C. | | |
|---|---|---|---|---|---|
| x = $v/v_m$ | Fraction of Molecules and Pressure P [atm] | Pressure P [mbar] | Mean Free Path λ [cm] | Surface ImpingeRate $Z_A$ [#/cm$^2$ – sec] | Volume Collision Rate $Z_V$ [#/cm$^3$ – sec] |
| 1.09 | 0.5 | 507 | $1.20 \times 10^{-5}$ | $1.44 \times 10^{23}$ | $2.21 \times 10^{28}$ |
| 2 | 0.046 | 46.6 | $1.43 \times 10^{-4}$ | $1.32 \times 10^{22}$ | $1.87 \times 10^{26}$ |
| 2.853 | $10^{-3}$ | 1.013 | $6.58 \times 10^{-3}$ | $2.89 \times 10^{20}$ | $8.83 \times 10^{22}$ |
| 3 | $4.4 \times 10^{-4}$ | 0.446 | $1.49 \times 10^{-2}$ | $1.27 \times 10^{20}$ | $1.71 \times 10^{22}$ |
| 3.250 | $10^{-4}$ | 0.1013 | 0.0658 | $2.89 \times 10^{19}$ | $8.83 \times 10^{20}$ |
| 3.917 | $10^{-6}$ | 0.001013 | 6.58 | $2.89 \times 10^{17}$ | $8.83 \times 10^{16}$ |
| 4 | $5.23 \times 10^{-7}$ | $5.30 \times 10^{-4}$ | 12.6 | $1.51 \times 10^{17}$ | $2.41 \times 10^{16}$ |
| 5 | $7.99 \times 10^{-11}$ | $8.09 \times 10^{-8}$ | 82,400 | $2.31 \times 10^{13}$ | $5.62 \times 10^{8}$ |
| 6 | $1.55 \times 10^{-16}$ | $1.57 \times 10^{-13}$ | | Not applicable | |

Equations 1-8 are derived from the Maxwell-Boltzmann Distribution Model which is a statistical model that depends on a large number of sampled molecules. Equations 1-8 are thus valid for a very wide range of molecules and pressures, including the entire practical range of molecules and pressures with respect to which the example embodiments of the vacuum pump 10 are intended for use.

Turning specifically to the rotatable surface 15 of the example embodiments of the vacuum pump 10, assuming the peripheral shape of the rotatable surface 15 is round, the tangential velocity $v_t$ of each point or area on the first surface 15*a* of the rotatable surface 15 is expressed by the following equation:

$$v_t = 2\pi r\omega$$

where r is the distance from the axis of rotation of the rotatable surface and ω is the rotational velocity of the rotatable surface at the axis of rotation. Relatedly, at each point, the tangential or centrifugal force (F) is expressed by the following equation:

$$F = \frac{mV_t^2}{r} = 4\pi^2 m\omega^2 r$$

where m is the mass at the point and r and $v_t$ are as given above.

From the foregoing, it is apparent that at the periphery 26 of the first surface 15*a*, the distance r is equal to the radius of the circle and the tangential velocity $v_t$ is at its maximum value for a given rotational velocity ω. Conversely, at the axis of rotation the tangential velocity $v_t$ is at its minimum value. Between these two extremes, the tangential velocity $v_t$ of each point on the first surface 15*a* increases linearly with incremental change in the distance r.

It is also apparent that for a given rotational velocity ω each point on the first surface 15*a* has a centrifugal force F that is related to the tangential velocity $v_t$ and the distance r from the axis of rotation. Like the tangential velocity $v_t$ the centrifugal force F also increases with the distance r from the axis of rotation, is at a maximum value at the periphery 26 and is at a minimum value at the axis of rotation. It is further apparent that the range and the maximum values of tangential velocity $v_t$ and centrifugal force F that can be achieved with the rotatable surface 15 can be adjusted by adjusting the value of the distance r from the axis of rotation, i.e., the radius of the rotatable surface 15, or the rotational velocity ω at which the rotatable surface 15 is rotated, or a combination of both.

Continuing with air as an example for purposes of description and turning now to operation of the example embodiments of the vacuum pump 10, at a starting or ambient pressure of approximately 1 atm, molecules of air exiting the low pressure portion 11 through the gas flow path 14 and openings 22 impinge on the first surface 15*a* of the rotatable surface 15 at random angles and with a distribution of velocities. The most probable velocity of the impinging air molecules is approximately Mach 1.2, i.e., 1.2 times the speed of sound.

The rotatable surface 15 of the example embodiments has a radius r and preferably rotates with a rotational velocity ω such that at least a portion of the first surface 15*a* of the rotatable surface 15 has a tangential velocity $v_t$ that is in the range of about 1 to 6 times the most probably velocity of the impinging air molecules. In this example, that corresponds to a range of $v_t$ of about Mach 1.2 to Mach 7.2, i.e., about 1.2-7.2 times the speed of sound (approx. 412-2,470 m/s).

However, it is to be understood that the rotatable surface 15 need not rotate and need not even be able to rotate with tangential velocity $v_t$ over the entire preferred range of about 1 to 6 times the most probable velocity with respect to every single gas to be pumped using the example embodiments of the vacuum pump 10. Rather, the preferred range of 1 to 6 times the most probable velocity represents a range of tangential velocities $v_t$ with which the example embodiments of the vacuum pump 10 can achieve target minimum pressure values ranging from approximately 0.5 atm to the mid-high vacuum range, e.g., $10^{-4}$ to $10^{-6}$ atm or even lower with a large variety of gases having a large range of molecular masses and most probable velocities.

In the specific case of air for example, given a starting or ambient pressure of about 1 atm and a target minimum pressure of about 0.5 atm to be reached, excellent pumping performance can be obtained with a $v_t$ as low about 1.1 times the most probable velocity, i.e., approx. 451 m/sec. Lower target minimum pressures in the mid-high vacuum range, e.g., $10^{-4}$-$10^{-6}$ atm can similarly be obtained rapidly and efficiently with $v_t$ in the range of about 3.3-4 times the most probable velocity, i.e., approx. 1,353-1,640 m/sec. Of course higher $v_t$ is preferable to compensate for the lower tangential velocities of the inner portions of the rotatable surface 15 inward of the outer periphery 26 and nearer to the axis of rotation, particularly at lower pressures where the mean free path of the molecules is larger and many molecules may not impinge on the peripheral edge 26 of the rotatable surface 15.

As noted previously, tangential velocity $v_t$ in the preferred range can be achieved with various combinations of rotatable surface 15 radius r (or diameter d) and rotational velocity ω. Generally, rotatable surfaces 15 having smaller values of diameter d can be rotated with higher values of rotational velocity ω to achieve tangential velocity $v_t$ in the preferred range, and rotatable surfaces 15 with larger values of diameter d can be rotated with lower rotational velocity ω to achieve tangential velocity $v_t$ in the preferred range. It is contemplated that rotatable surfaces 15 with greater diameters d will impose lesser demands on the drive 16 to produce higher values of rotational velocity ω to achieve the preferred range of tangential velocities $v_t$. Accordingly, the example embodiments of the vacuum pump 10 can be scaled up using larger diameter rotatable surfaces 15 to provide greater pumping speeds than conventional vacuum pumps can be scaled to achieve. Table 3 below illustrates some of the many possible combinations of rotatable surface 15 diameter d and rotational velocity ω that can produce tangential velocities $v_t$ in the preferred range for various gases, including air, nitrogen, chlorine, and helium at a temperature condition of 20° C.

TABLE 3

| Diameter (meters) | Rotational Velocity (ω) (rpm) | Tangential Velocity ($v_t$) (meters/sec.) | Air at 20° C. Mach Value | Times Most Probable Velocity at 20° C. of Air/Nitrogen/Chlorine/Helium |
|---|---|---|---|---|
| 0.25 | 80K-100K | 1047-1309 | 3.1-3.8 | 2.6-3.2/2.5-3.1/2.8-3.5/0.9-1.2 |
| 0.5 | 40K-80K | 1047-2094 | 3.1-6.1 | 2.6-5.1/2.5-5.0/2.8-5.7/0.9-1.9 |
| 1 | 20K-30K | 1047-1571 | 3.1-4.6 | 2.6-3.8/2.5-3.8/2.8-4.2/0.9-1.4 |
| 2 | 10K-20K | 1047-2094 | 3.1-6.1 | 2.6-5.1/2.5-5.0/2.8-5.7/0.9-1.9 |
| 5 | 4K-10K | 1047-2618 | 3.1-7.6 | 2.6-6.4/2.5-6.3/2.8-7.1/0.9-2.4 |
| 10 | 2000-3600 | 1047-1885 | 3.1-5.5 | 2.6-4.6/2.5-4.5/2.8-5.1/0.9-1.7 |

It will be apparent from the last column of Table 3 and from Table 1 that molecules with light mass, such as molecules of the inert gases Helium and Neon and molecules of Hydrogen, have 2 to 3 times longer mean free paths λ than Nitrogen. In addition, the most probable velocities $v_m$ of Neon and Hydrogen are 1.2 and 3.7 times higher respectively than the $v_m$ of Nitrogen, and the most probable velocities $v_m$ for other heavier gases are even greater. Both longer λ and higher $v_m$ compound the deterioration of the effectiveness of the pumping speed and the ultimate pressure that can be achieved by the conventional mechanical pumps. This is because the conventional mechanical pumps depend on restricting the leak back path in order to maintain the pressure differential for their pump down mechanism. Because they have long mean free path λ and high $v_m$ velocity, the light mass gas molecules are inherently more likely to leak back to cause the loss of vacuum. Conventionally, the light mass molecules are pumped using cryopumps and reactive sputtering pumps, otherwise the vacuum system must contend with the consequences of oil vapor contamination if oil sealed pumps are used. Even scaled-up versions of the conventional mechanical pumps cannot overcome the inherent nature of the properties of the light mass gases. In contrast, a scaled-up version of the current example embodiments can be used to pump down gases having molecules with long mean free path and high velocity mechanically. The example embodiments can be scaled-up by a combination of larger diameter d, higher rotational velocity ω, and/or a wider width of the radius of the ring/disk for the rotatable surface 15, which is described below, and/or a smaller space gap 29 to meet the preferred 1 to 6 times most probable velocity $v_m$ range requirement, to thus increase multiple number of impingements and to discriminate the chance of molecules to leak back through the gap.

It is contemplated that depending on the specific needs for a particular application for the example embodiments of the vacuum pump 10, the diameter of the rotatable surface 15 could be quite large as compared to the diameter of the sets of rotating blades or vanes of conventional vacuum pumps. However, it will be appreciated that due to the unique arrangement of the rotatable surface 15 described herein in comparison to conventional vacuum pumps the example embodiments of the vacuum pump 10 can be constructed with a significantly lower profile than conventional vacuum pumps. Further, the example embodiments of the vacuum pump 10 described herein are capable of operating across a much wider range of pressures than conventional vacuum pumps and therefore a single vacuum pump 10 comprising a single pumping stage as described herein can be used in place of multiple conventional vacuum pumps and pumping stages and achieve comparable or better pumping results.

It will be further appreciated that the rotatable surface 15 need not be rotated at the same rotational velocity ω over the entire pressure range from the starting or ambient pressure down to the target minimum pressure. For example, so long as the rotatable surface 15 maintains a rotational velocity ω sufficient for at least part of the first surface 15*a* to have a tangential velocity $v_t$ within the preferred range described herein, the rotatable surface 15 can be rotated at one rotational velocity ω when the pressure is at and near the starting or ambient pressure, and at another higher rotational velocity Δω as the pressure drops toward the target minimum pressure. Thus, it can be rotated with one rotational velocity ω to produce a first tangential velocity $v_t$ nearer the lower end of the preferred $v_t$ range when the pressure is relatively high and the gas molecules exert more drag on the rotatable surface 15, and at a second rotational velocity Δω to produce a second tangential velocity $v_t$ nearer the upper end of the preferred range when the pressure is relatively low and the remaining gas molecules exert less drag on the rotatable surface 15. Such operation can be more efficient than rotating the rotatable surface 15 continuously at a single value of rotational velocity. The rotatable surface 15 also can be rotated at a plurality of different rotational velocities $v_t$ over a range of pressure values as gas is pumped out and the rotational velocity can be changed in discrete steps or even continuously if desired.

It also is to be understood that the entire surface area of the first surface 15*a* of the rotatable surface 15 need not rotate with tangential velocity $v_t$ in the preferred 1 to 6 times most probable velocity range. Rather, excellent pumping performance can be achieved with only a portion of the surface rotating within the preferred tangential velocity $v_t$ range. For example, in the case of the example disk embodiments of the rotatable surface 15, the portion may comprise just the outer periphery 26, or the outer periphery 26 and all or part of the surface area of the first peripheral surface portion 31 of the first surface 15*a* extending inward from the outer peripheral edge 26*a*, or the outer periphery 26 and any portion of the surface area of the first surface 15*a* extending inwardly from the peripheral edge 26*a* up to and including the entire surface area of the first surface 15*a*. In the case of the example ring embodiments of the rotatable surface 15, the portion may comprise just the outer periphery 26, or the outer periphery 26 and a portion of the surface area of the first peripheral surface portion 31 of the first surface 15*a* extending inward from the outer peripheral edge 26*a* up to and including the entire surface area of the first peripheral surface portion 31. It will be appreciated that the greater the surface area that rotates with tangential velocity $v_t$ in the preferred range, the greater the number and volume of impinging gas molecules that can be pumped out per unit of time and thus the more rapidly and efficiently the example embodiments of the vacuum pump 10 can reduce the pressure in the low pressure portion 11 from a starting or ambient pressure to a selected target minimum pressure.

Figure 11:
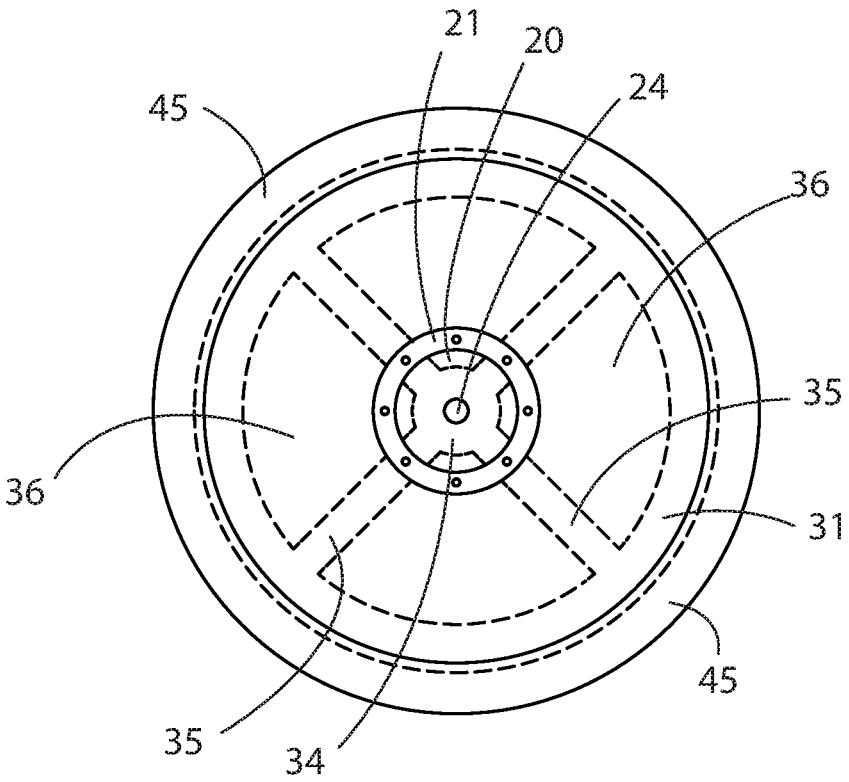
FIG. 11 is a top plan view partially transparent of the non-sealed vacuum pump with a bladeless gas impingement surface rotatable at supersonic speed of FIG. 9 omitting the open frame.

With respect to the example ring embodiment of the rotatable surface 15 specifically, a preferred range of widths of the first peripheral surface portion 31 can be expressed in relation to the width of the rotatable surface 15, where the width of the rotatable surface 15 corresponds to the distance from the axis of rotation to the outer peripheral edge 26*a* and the width of the first peripheral surface portion 31 corresponds to the distance between the outer peripheral edge 26*a* and the inner peripheral edge 33 as best seen in FIGS. 11 and 12D. In the case where the rotatable surface 15 is substantially circular, the width of the rotatable surface 15 corresponds to its radius r. The width of the first peripheral surface portion 31 will preferably be in a range of about 0.05 to 0.5 times the radius of the rotatable surface 15 but may extend to the entire radius. Expressed differently, the width of the first peripheral surface portion 31 preferably is in a range between about 5-50% up to about 100% of the width of the radius of the rotatable surface 15.

With the first surface 15*a* rotating within the described preferred range of tangential velocity $v_t$, molecules impinging on the first surface 15*a* at an angle of incidence and with a velocity v first receive a mirror reflection angle change component in the same forward direction of the angle of incidence, for example, a clockwise incident angle of 307=270+37 degrees with respect to the normal will have 53=90-37 degree reflected angle by itself alone. The velocity vector v flips its angle of direction by the total mirror reflection and is now designated velocity vector v'. Then the velocity vector v' is vectorially added to the tangential velocity $v_t$ using the vectors addition triangle combination of ($v_t$+v'). For a $v_t$ larger than the $v_m$ of the rotatable surface 15, all impinging molecules with any incident velocity v, independent of the initial magnitude and direction of v, will be eventually redirected and ejected outwardly with speed larger than the magnitude of $v_t$ from the outer periphery 26 of the rotatable surface 15 to the high pressure portion 12 after one or multiple impingements of those molecules on the rotatable surface 15. The molecules that remain in the low pressure portion 11 and are not pumped out are thus those with velocity v larger than $v_t$, which leak-back and return from the high pressure portion 12 to the low pressure portion 11. Table 1 shows that the fraction of such high velocity molecules, for example with v at and larger than 4 times $v_m$ is less than $5\times10^{-7}$, which corresponds to the theoretical lowest pressure that can be achieved in the low pressure portion 11.

Accordingly, when the rotatable surface 15 is rotated with tangential velocity $v_t$ within the preferred range described, the gas molecules exiting from the low pressure portion 11 and impinging on the first surface 15*a* of the rotatable surface 15 are ejected outward from the periphery 26 of the rotatable surface 15 at a rate and volume that is substantially greater than the high velocity gas molecules can leak-back and fill the resulting void in the low pressure portion 11. As a result, the pressure in the low pressure portion 11 is rapidly and efficiently reduced. The greater the multiple by which the tangential velocity $v_t$ exceeds the most probable velocity $v_m$ of the impinging molecules and the greater the surface area of the first surface 15*a* of the rotatable surface 15 that rotates with such tangential velocity $v_t$, the greater the number and volume at which the impinging molecules are redirected outward and the more rapidly the pressure in the low pressure portion 11 is reduced to a target minimum value.

Because the outward directional momentum the first surface 15*a* of the rotatable surface 15 imparts to the impinging molecules is very substantial and because the net rate of outward flow of the impinging gas molecules substantially exceeds the rate at which gas molecules are able to leak-back and re-enter the low pressure portion 11 through the gas flow path 14 to fill the resulting void, there is no need for a seal to prevent gas molecules from leaking back from the high pressure portion 12 to the low pressure portion 11 through the gas flow path 14. Even if some gas molecules are able to leak back, the percentage is so small compared to the number and volume of gas molecules flowing outward that even without a seal continued operation of the vacuum pump 10 progressively reduces the number of molecules in the low pressure portion 11 until the target minimum pressure, for example $10^{-6}$ atm, is reached.

As the pressure in the low pressure portion 11 continues to drop, the mean free path of the air molecules continues to increase and the rate of impingement of the air molecules on the first surface 15*a* of the rotatable surface 15 continues to decrease. As described above, the mean free path of air molecules at 20° C. increases from about $6.58\times10^{-6}$ cm at 1 atm to approximately $13.2\times10^{-6}$ cm at 0.5 atm, approximately $6.58\times10^{-2}$ cm at $10^{-4}$ atm, and approximately 6.58 cm at $10^{-6}$ atm. The mean free paths of molecules of other gases will similarly increase with decreasing pressure with some being greater than air and some less.

The gap or space 29 between the first surface 15*a* of the rotatable surface 15 and the surface 13*a* of the partition 13 that is exposed to the high pressure portion 12 acts as a sort of conduit for the flow of the gas molecules outward from the periphery 26 of the rotatable surface 15. It is preferred that the dimension of the gap 29 be small in order to physically minimize and discriminate the high velocity molecules that may possibly back-flow from the high pressure portion 12 through and near the gap 29 and into the low pressure region 11. At the same time, making the dimension of the gap 29 too small has a tendency to inhibit the net outward flow of gas molecules and thus reduce pumping efficiency.

In addition, the dimension of the gap 29 has an effect on the lowest target minimum pressure the example embodiments of the vacuum pump 10 can practically achieve. As the pressure of the gas in the low pressure portion 11 drops, the mean free path λ of the gas molecules increases, the impingement rate of the molecules on the first surface 15*a* of the rotatable surface 15 decreases, and pumping efficiency is reduced. However, any slower velocity molecules with shorter mean free paths that leak back from the high pressure portion 12 near the periphery edge 26*a* are subject to being re-ejected again by multiple impingements on the first surface 15*a* before the molecules can penetrate deeper into the low pressure portion 11. The re-ejections of the slower returning molecules keeps/protects the low pressure portion at low pressure. If the drive 16 has capacity to further increase the rotational velocity of the rotatable surface 15 as the pressure drops, the pumping efficiency can be maintained to an extent even as the pressure continues to drop. However, at some point the maximum rotational velocity the drive 16 can generate is reached and the pressure drops to a point where due to the combination of the long mean free path and the low impingement rate of the gas molecules on the first surface 15*a* the rotatable surface 15 is no longer able to eject impinging gas molecules outwardly at a rate and volume that is sufficient to substantially overcome the leak-back of gas molecules from the high pressure portion 12 to the low pressure portion 11 through the gap 29 and the gas flow path 14. In other words, the vacuum pump 10 is no longer able to produce a sufficient pressure differential between the high pressure portion 12 and the low pressure portion 11 to substantially prevent the leak-back of gas. This point corresponds to the lowest target minimum pressure value the vacuum pump 10 is practically able to achieve. In light of the above-described trade-offs and as indicated previously, the space or gap 29 preferably has a dimension in the range of approximately 0.5 mm to approximately 100 mm, which enables the example embodiments of the vacuum pump 10 to operate with a variety of gases and to achieve minimum target pressure values down to the mid-high vacuum range, e.g., $10^{-4}$ to $10^{-6}$ atm, and even lower pressures in the high to ultra-high vacuum range depending on the particular construction, dimensions, and operating parameters employed.

Another consideration is that with the small dimensions contemplated for the gap 29 the viscosity of gas molecules along the surface 13*a* of the partition 13 can produce a drag against rotation of the rotatable surface 15. This is due to the fact that the surface 13*a* of the partition 13 is stationary. As a result, the gas molecules adjacent to the stationary surface 13*a* encounter a resistance to flow, i.e., viscosity. The resulting drag is proportional to the gradient of the velocity and is greatest at the smallest distance between the first surface 15*a* of the rotatable surface 15 and the surface 13*a* of the partition 13. This resistance is communicated to the rotatable surface 15 through the gas molecules between the stationary surface 13*a* and the rotating first surface 15*a* and manifests as a drag against rotation of the rotatable surface 15. To counter this effect, the rotatable surface 15 optionally can be provided with a thin cylinder 41 that extends around the peripheral edge 26*a* as illustrated in FIGS. 12O-12P.

The cylinder 41 comprises a cylinder wall 42 with a cylinder rim 43. The cylinder wall 42 extends around the peripheral edge 26*a* of the rotatable surface 15 and outwardly from the rotatable surface 15 in a direction substantially perpendicular to the first surface 15*a* and the second surface 15*b*. The cylinder wall 42 can extend outwardly from either or both of the first surface 15*a* and the opposite second surface 15*b*, whichever is in proximity to a stationary surface and subject to viscosity-induced drag regardless whether the stationary surface comprises the partition 13, the interior surface of a housing, chamber, or other enclosure, or both. When the rotatable surface 15 is positioned adjacent and in close proximity to the partition 13 as described above, the cylinder rim 43 is in closer proximity to the stationary surface 13*a* of the partition 13 than the rotatable first surface 15*a*. The surface area of the cylinder rim 43 that faces and is in proximity to the stationary surface 13*a* is a very small fraction of the surface area of the first surface 15*a* and thus encounters a very small fraction of the drag from the gas molecules adjacent to the stationary surface 13*a* compared to the first surface 15*a*. The same would apply if the rotatable surface 15 was positioned so that the first surface 15*a* and/or second surface 15*b* was in close proximity to the stationary interior surface of a housing, chamber, or other enclosure 45 such as in the example embodiment illustrated in FIGS. 3-10 and described below.

To prevent the outward ejection of gas molecules from the periphery 26 of the rotatable surface 15 being blocked by the cylinder wall 42, a slope, incline, or ramp 44 can be provided and can extend inwardly from the cylinder wall 42 toward the axis of rotation of the rotatable surface 15. The slope, incline or ramp 44 may but need not extend inwardly from the cylinder rim 43. In addition, the slope, incline, or ramp 44 can extend from the cylinder wall 42 to either or both of the first surface 15*a* and the second surface 15*b* of the rotatable surface 15 depending on the orientation and positioning of the rotatable surface 15 with respect to interior stationary surfaces of the vacuum pump 10. As impinging gas molecules are redirected by the rotatable surface 15 outwardly toward the periphery 26, they collide with the ramp 44 and are deflected outwardly from the periphery 26, away from the first and/or second surface 15*a*, 15*b*, and beyond the cylinder rim 43 at an angle approximately corresponding to the angle of the slope, incline or ramp 44.

An alternative example embodiment of the vacuum pump 10 and several variations are illustrated in FIGS. 3-10. Except as otherwise described below and illustrated, the alternative embodiment comprises substantially the same rotatable surface 15 and drive 16 as the example embodiment of FIGS. 1-2. The alternative example embodiment of the vacuum pump 10 comprises an outer housing, chamber, or other enclosure 45 ("outer enclosure") having a wall 46 that is substantially gas impermeable and that defines an interior space 47. The interior space 47 may be partially enclosed by the outer enclosure 45. In some configurations, the wall 46 of the outer enclosure 45 may be truncated and terminate at or slightly past the peripheral edge 26*a* of the rotatable surface 15*a* such that the interior space 47 comprises only the low pressure 11 portion. In other configurations, the wall 46 may extend past the peripheral edge 26*a* for some distance and the interior space 47 may comprise at least some of the high pressure portion 12. In that case, the interior space 47 may be partially open to the ambient environment and partially enclosed by the outer enclosure 45. The outer enclosure 45 and the wall 46 can be constructed of a suitably strong material such as a metal or carbon composite. In the alternative embodiment, there is no partition 13 in the interior space 47 as in the example embodiment of FIGS. 1-2. Instead, the rotatable surface 15 is arranged and positioned within the interior space 47 to divide the interior space 47 into a low pressure portion 11 and a high pressure portion 12. The wall 46 has an interior surface 46*a* and extends around the periphery 26 of the rotatable surface 15 with at least a portion of the interior surface 46*a* being adjacent and in close proximity to the peripheral edge 26*a* of the rotatable surface 15. The peripheral edge 26*a* and the interior surface 46*a* are separated by a small gap or space 29.

The portion of the interior space 47 that is bounded by the wall 46 and the first surface 15*a* of the rotatable surface 15 (except for the small gap or space 29) comprises the low pressure portion 11. The portion of the interior space 47 on the opposite side of the rotatable surface 15 comprises the high pressure portion 12. Accordingly, the first surface 15*a* of the rotatable surface 15 faces and is exposed to the low pressure portion 11 and the second surface 15*b* of the rotatable surface 15 faces and is exposed to the high pressure portion 12.

The high pressure portion 12 can be open or partially open to the ambient environment in the same manner as described above with respect to the example embodiment of FIGS. 1-2. The high pressure portion 12 also may be at least partially enclosed within the interior space 47 defined by the outer enclosure 45 and/or may be substantially closed to the ambient environment except for one or more gas outlets in gaseous communication with the high pressure portion 12.

The small gap or space 29 between the peripheral edge 26*a* of the rotatable surface 15 and the interior surface 46*a* of the wall 46 comprises a sort of conduit for the outward flow of gas molecules from the low pressure 11 to the high pressure portion 12 in the same manner described above with respect to the example embodiment of FIGS. 1-2. The outward flow of gas molecules from the periphery 26 of the rotatable surface 15 is thus at least partially directed by the stationary interior surface 46*a* of the wall 46. The low pressure portion 11 and the high pressure portion 12 are in direct gaseous communication through the gap or space 29. However, for the same reasons described above with respect to the example embodiment of FIGS. 1-2, there is no need for a seal between the low pressure portion 11 and the high pressure portion 12 to prevent gas from leaking back from the high pressure portion 12 to the low pressure portion 11 and it is preferred that no such seal is used for that purpose.

The outer enclosure 45 can have any desired geometric shape including the conical shape illustrated in FIGS. 3-10. Examples include a dome shape, cylindrical shape, rectangular or square shape, or any other suitable shape. Regardless of the interior or exterior shape of the outer enclosure 45 and the interior space 47, it is preferred that at least a portion of the interior surface 46*a* of the wall 46 that is adjacent to the peripheral edge 26*a* of the rotatable surface 15 extend at an angle outwardly and away from the periphery 26 rotatable surface 15 in order to deflect and guide gas molecules ejected outwardly from the periphery 26 away from the rotatable surface 15 and into the high pressure portion 12 in the direction of the arrows shown in FIGS. 4-8 and others. It is preferred that the portion of the interior surface 46*a* that is adjacent to the peripheral edge 26*a* of the rotatable surface 15 have an angle in the range of between about 10-80 degrees in relation to the first and second surfaces 15*a*, 15*b* of the rotatable surface 15 for this purpose. The angled relationship between the stationary interior surface 46*a* of the wall 46 and the first and second surfaces 15*a*, 15*b* of the rotatable surface 15 also functions to reduce the gradient of the velocity and thus to reduce the drag on the rotatable surface 15 due to the viscosity of the gas molecules adjacent to the stationary interior surface 46*a* even at atmospheric pressure by directing the impinging gas molecules ejected outwardly from the periphery 26 of the rotatable surface 15 away from the small gap or space 29 between the rotating peripheral edge 26*a* of the rotatable surface 15 and the stationary interior surface 46*a* of the wall 46.

Figure 6:
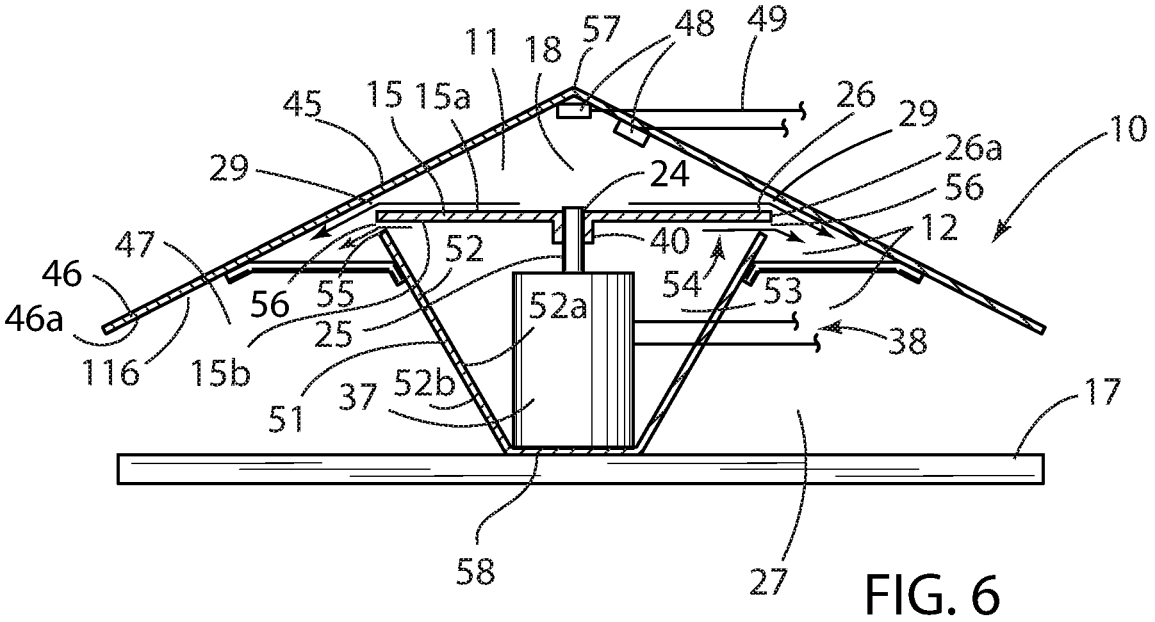
FIG. 6 is a cross-sectional view of the non-sealed vacuum pump with a bladeless gas impingement surface rotatable at supersonic speed of FIG. 5 with optional components in a low pressure portion of the pump.
Figure 7:
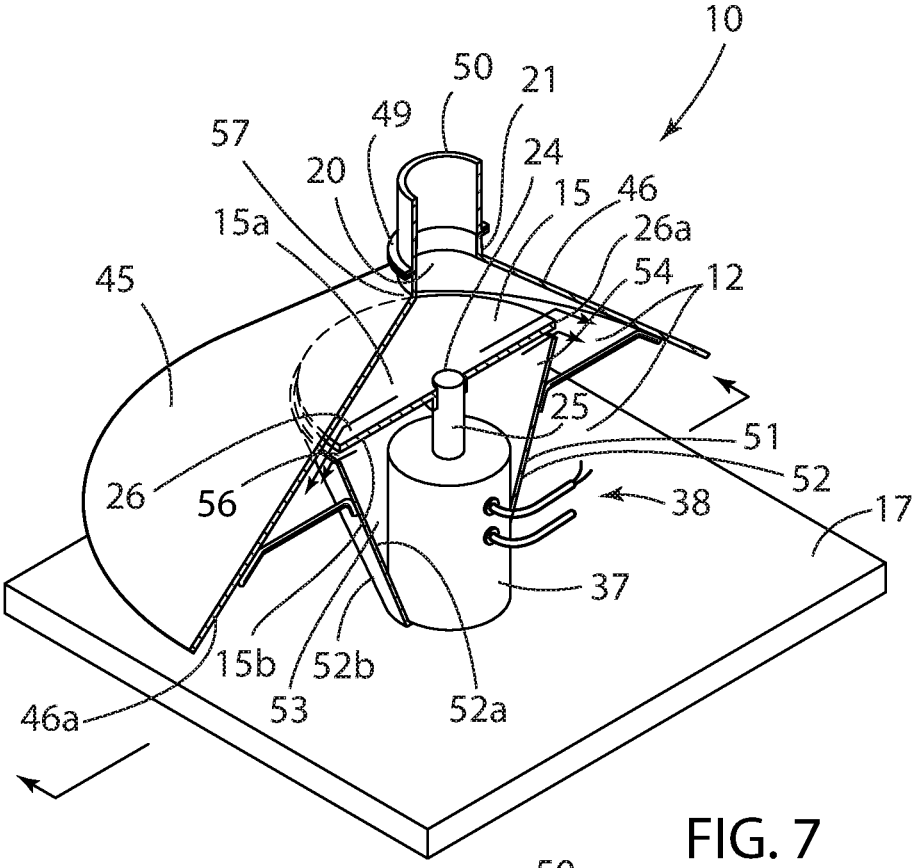
FIG. 7 is a top perspective view partially in cross section and partially transparent of a non-sealed vacuum pump with a bladeless gas impingement surface rotatable at supersonic speed according to variation of the example embodiment of FIG. 5.
Figure 8:
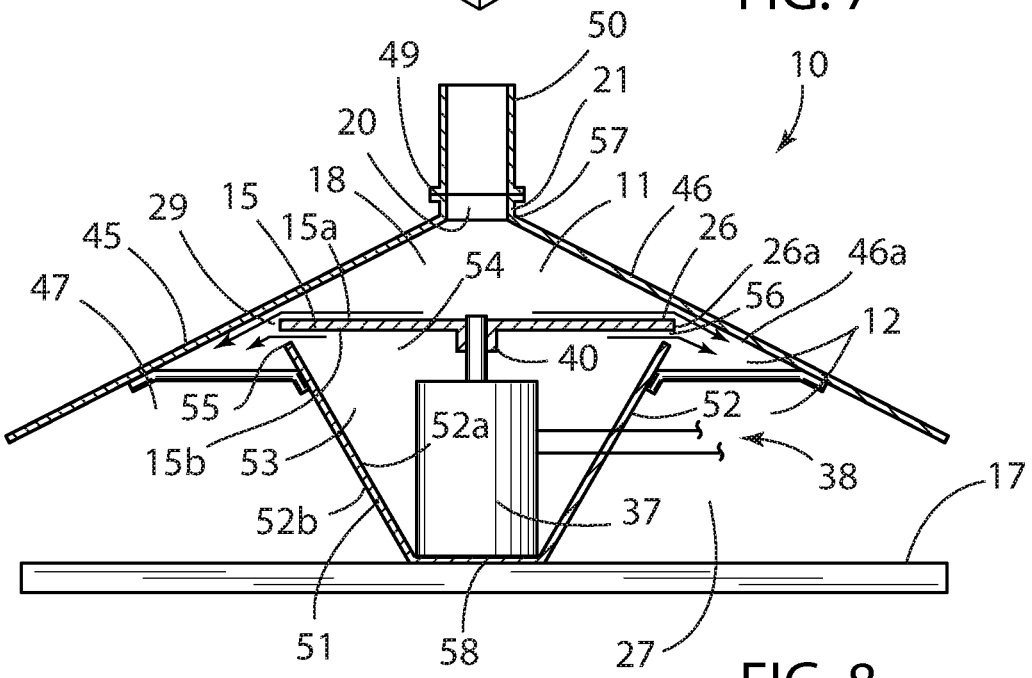
FIG. 8 is a cross-sectional view of the non-sealed vacuum pump with a bladeless gas impingement surface rotatable at supersonic speed of FIG. 7.

In one variation illustrated in FIG. 6, various items 48 may be positioned in the low pressure portion 11 of the interior space 47. Items 48 may include but are not limited to instruments, gauges, reactors or other vacuum components, and items to be depressurized. Such items 48 can be permanently or temporarily located in the low pressure portion 11 and can for example be mounted, affixed, or attached to the interior surface 46*a* of the wall 46. To the extent that electrical wires 49 or the like are required for the items 48, they may be passed through the wall 46 via suitably sealed feedthroughs or passages.

In another variation illustrated in FIGS. 7-10, the outer enclosure 45 may have one or more gas inlets 21 and openings 20 in gaseous communication with the low pressure portion 11. One or more of the gas inlets 21 may have a connector such as a flange 49 for coupling with a gas line or conduit 50 to bring the low pressure portion 11 into gaseous communication with another housing or chamber or even the external ambient environment.

The alternative embodiments illustrated in FIGS. 3-10 operate in essentially the same manner and achieve substantially the same results as described above with respect to the example embodiment of FIGS. 1-2. In addition, all of the characteristics relating to the various elements that are common between the example embodiments, including all of the preferred ranges of dimensional and operational values described above, are the same.

With the arrangement of the alternative example embodiment as described, the first surface 15*a* of the rotatable surface 15 is impinged on by molecules of the gas in the low pressure portion 11 and are ejected outwardly from the outer periphery 26 of the rotatable surface 15 and directed into the high pressure portion 12 in the same manner as described previously with respect to the example embodiments illustrated in FIGS. 1-2. In addition, the second surface 15*b* of the rotatable surface 15 is impinged on by molecules of the gas in the high pressure portion 12.

Because the rotatable surface 15 rather than a fixed partition or other structure divides or separates the low pressure portion 11 and the high pressure portion 12 (except for the small gap 29 shown in FIGS. 3-4) as the pressure in the low pressure portion 11 drops, the pressure differential between the second side and surface 15*b* of the rotatable surface 15 that is exposed to the high pressure portion 12 and the first side and surface 15*a* of the rotatable surface 15 that is exposed to the low pressure portion 11 increases. When the alternative example embodiment of the vacuum pump 10 is used to achieve a target minimum pressure in the mid-high vacuum range, e.g., $10^{-4}$ to $10^{-6}$ atm, the maximum pressure differential between the first and second sides can reach many orders of magnitude.

Such large magnitudes of pressure differential can potentially result in temporary or permanent deformation, such as warping or bending, of the rotatable surface 15, or even permanent damage or destruction, particularly if the rotatable surface 15 is constructed to be very thin and lightweight as is preferred. In addition, as the rotatable surface 15 rotates, the second surface 15*b* that is exposed to the high pressure portion 12 is impinged on by gas molecules in the high pressure portion 12. This impingement results is an undesirable source of extra drag against the rotation of the rotatable surface 15 and can reduce pumping efficiency.

To mitigate against these effects, according to another variation an additional enclosure 51 can be provided in the high pressure portion 12 around the second surface 15*b* of the rotatable surface 15 as illustrated in FIGS. 5-10. The additional enclosure 51 includes a wall 52 with an interior surface 52*a* and an exterior surface 52*b*. The wall 52 is constructed of a gas impermeable material and is shaped to define an interior space 53 with an opening 54. The additional enclosure 51 has an edge 55 that extends around the opening 54 between the interior and exterior surfaces 52*a*, 52*b*. The additional enclosure 51 is positioned within the high pressure portion 12 so that the interior space 53 of the additional enclosure 51 encloses a space or region in the high pressure portion 12 that is adjacent to the second surface 15*b* of the rotatable surface 15 and to which the second surface 15*b* is exposed. The additional enclosure 51 is also positioned so that the opening 54 is located adjacent to the second surface 15*b* with the edge 55 around the opening 54 being separated from the second surface 15*b* by a small gap or space 56. The gap or space 56 preferably has a dimension that is slightly less than the gap 29 between the peripheral edge 26*a* of the rotatable surface 15 and the interior surface 46*a* of the wall 46 of the outer enclosure 45. The opening 54 preferably has substantially the same peripheral shape as the second surface 15*b*, e.g., round, and an outer peripheral dimension, e.g., diameter, that is very slightly less than the outer peripheral dimension of the second surface 15*b* so that the peripheral edge 26*a* of the rotatable surface 15 and a small portion of the second surface 15*b* immediately inward from the peripheral edge 26*a* remain exposed to the high pressure portion 12 outside the additional enclosure 51.

With the additional enclosure 51 arranged in relation to the second surface 15*b* of the rotatable surface 15 as described, the interior space 53 of the inner enclosure 51 defines a space or region of low pressure adjacent to the second surface 15*b*. This is because as the rotatable surface 15 rotates with at least the outer periphery 26 having tangential velocity $v_t$ in the described preferred range, the gas molecules impinging on the second surface 15*b* are rapidly ejected outwardly from the periphery 26 of the second surface 15*b* in the direction of arrows shown in FIGS. 5-10 through the small gap 56 between the second surface 15*b* and the edge 55 of the additional enclosure 51. The molecules are ejected outwardly at a rate and volume substantially greater than they can be replaced by molecules leaking back through the gap 56 and thus the pressure in the interior space 53 of the inner enclosure 51 is reduced in the same manner as the pressure in the low pressure portion 11. The reduction of pressure in the space or region adjacent to the second surface 15*b* and to which the second surface 15*b* is exposed substantially reduces the pressure differential between the first and second sides and surfaces 15*a*, 15*b* of the rotatable surface 15 over substantially the entire pressure range from the starting or ambient pressure to the intended target minimum pressure. The reduction of pressure in the space or region adjacent to the second surface 15*b* also substantially reduces the drag against rotation of the rotatable surface 15 from gas molecules impinging on the second surface 15*b*.

As indicated above with respect to the outer enclosure 45, the additional enclosure 51 also may be constructed in various shapes. In a preferred embodiment, the outer enclosure will be constructed in a cone shape and the additional enclosure 51 will be constructed as an inverted cone as illustrated in FIGS. 6-10. With this arrangement, the interior surface 46*a* of the wall 46 of the outer enclosure 45 extends outwardly from a central apex or truncated apex 57 at a slope around and past the peripheral edge 46*a* of the rotatable surface 15 and the wall 52 of the additional enclosure 51 extends outwardly from a central apex or truncated apex 58 at a slope toward the sloping interior surface 46*a* of the outer enclosure 45 and terminates at the edge 55 of the opening 54 of the additional enclosure 51 adjacent to the second surface 15*b* of the rotatable surface 15. In a preferred arrangement, the angles or slopes of the interior surface 46*a* of the outer enclosure 45 and the wall 52 of the additional enclosure 51 are not symmetrical with respect to the first and second surfaces 15*a*, 15*b* of the rotatable surface 15. In a preferred arrangement, the gap 56 between the edge 55 of the additional enclosure 51 and the second surface 15*b* of the rotatable surface 15 is slightly smaller than the gap 29 between the peripheral edge 26*a* of first surface 15*a* of the rotatable surface 15 and the interior surface 46*a* of the wall 46 of the outer enclosure 45.

In the preferred arrangements, the outward flow of gas molecules from the first and second surfaces 15*a*, 15*b* of the rotatable surface 15 are facilitated by separating the flows to at least some extent so that they do not interfere, which could congest the net outward flow of gas and reduce pumping efficiency. The difference in gap dimensions may result in a small pressure differential remaining between the first and second sides and surfaces 15*a*, 15*b* of the rotatable surface 15 as pressure is reduced toward the intended target minimum pressure. However, the differential is small enough that there is no risk of deformation of the rotatable surface 15.

In another variation illustrated in FIGS. 9-10, the additional enclosure 51 and the outer enclosure 45 can be connected together in a frame 59. The frame 59 can be open or partially open to the ambient environment. The frame 59 can comprise a single continuous peripheral member 60 or a plurality of discrete spaced apart peripheral members 60 and a plurality of cross-members 61. The peripheral members 60 and cross-members 61 can be arranged to form a frame 59 with a peripheral footprint that is substantially circular, square, rectangular, polygonal, an irregular geometric shape, or any other shape desired. The peripheral members 60 and cross-members 61 can be constructed of a rigid material such as a metal and can be interconnected to form a frame 59 that is substantially rigid. The cross-members 61 can be arranged to interconnect the outer enclosure 45 and the inner enclosure 51 containing the drive 16 and rotatable surface 15 with the peripheral members 60 at multiple locations to produce a single unit. The single unit can be portable, or can be permanently or temporarily fixed in place to a mounting base 17 or a surface of a larger structure such as the floor or a wall of a facility.

If the drive motor 37 is enclosed within the inner enclosure 51, electrical lines and cooling feeds and returns 38 can be fed to the drive motor 37 through the wall 52 of the inner enclosure 51 via suitably sealed vacuum feed-throughs or passages. If the drive motor 37 is located external to the inner enclosure 51, the drive shaft 25 can pass through the wall 52 of the inner enclosure 51 through a suitably sealed bearing or the like.

Another variation is illustrated in FIGS. 12K-12N. In this variation, a plurality of rotatable surfaces 15 are arranged spaced apart and substantially parallel in a substantially stacked configuration. Arranging a plurality of rotatable surfaces 15 in a stack is one approach for providing additional surface area for impingement by molecules of a gas being pumped.

The plurality of rotatable surfaces 15 can be interconnected to form a single unitary structure as illustrated in FIGS. 12K-12N or can be separate structures. Configured as a unitary structure, the plurality of rotatable surfaces 15 can be interconnected by one or more interconnection bridges 62. The interconnection bridge or bridges 62 can extend between and interconnect adjacent surfaces of the rotatable surfaces 15 in the stack. The adjacent surfaces can comprise the first and second surfaces 15*a*, 15*b* of adjacent rotatable surfaces 15 in the stack on which gas molecules are intended to impinge, and can include the adjacent first and second peripheral surface portions 31, 32 of the adjacent rotatable surfaces 15. The adjacent surfaces can also include adjacent surfaces of the spokes 35 that extend between the central hub portion 34 and the first and second peripheral surface portions 31, 32 in the example ring embodiments of the rotatable surfaces 15. The interconnection bridge or bridges 62 can but need not necessarily extend between the adjacent surfaces substantially perpendicular to the planes of the adjacent surfaces.

Figure 12K:
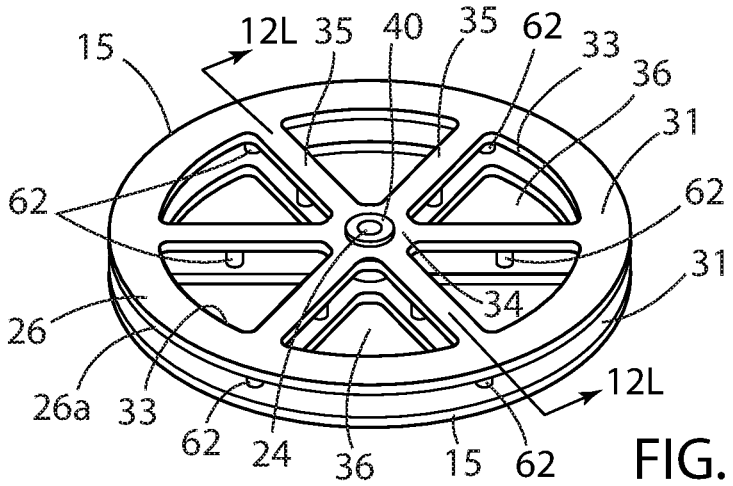
FIG. 12K is a top perspective view of one variation of a plurality of rotatable rings of a non-sealed vacuum pump with a bladeless gas impingement surface rotatable at supersonic speed in a stacked arrangement according to an example embodiment.
Figure 12L:
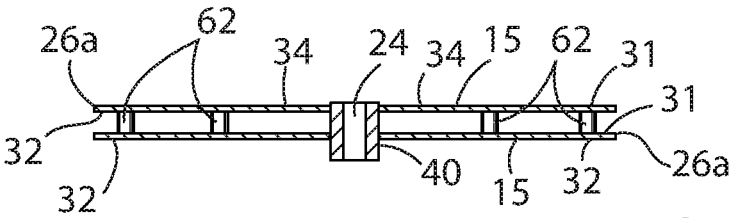
FIG. 12L is a cross-sectional side view of the plurality of rotatable rings in a stacked arrangement of FIG. 12K.

In one variation illustrated in FIGS. 12K-12L, a plurality of separate and discrete interconnection bridges 62 in the form of a plurality of columns or pillars can extend between the adjacent surfaces of the stacked rotatable surfaces 15. The interconnection bridges 62 may be spaced apart around the central openings 24 of the stacked rotatable surfaces 15 at a plurality of locations and at various distances radially outward between the central openings 24 and the peripheral edges 26*a* of the stacked rotatable surfaces 15, including between the adjacent surfaces of the spokes 35 in the case of the example ring embodiments of the rotatable surfaces 15.

Figure 12M:
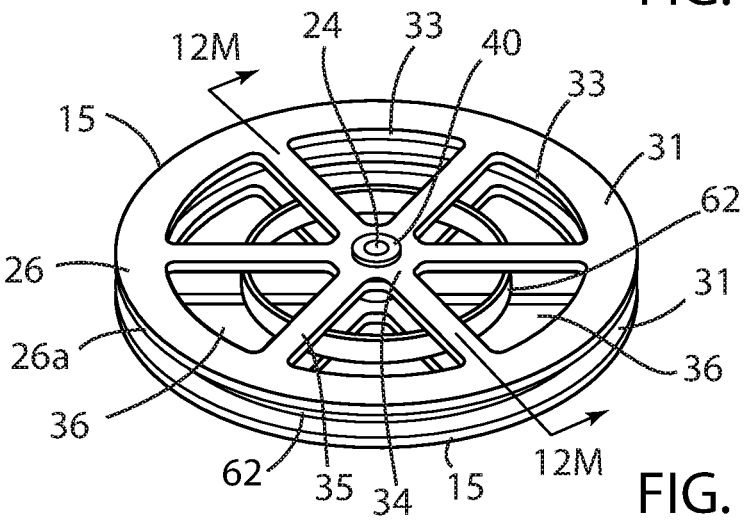
FIG. 12M is a top perspective view of another variation of a plurality of rotatable rings of a non-sealed vacuum pump with a bladeless gas impingement surface rotatable at supersonic speed in a stacked arrangement according to an example embodiment.
Figure 12N:
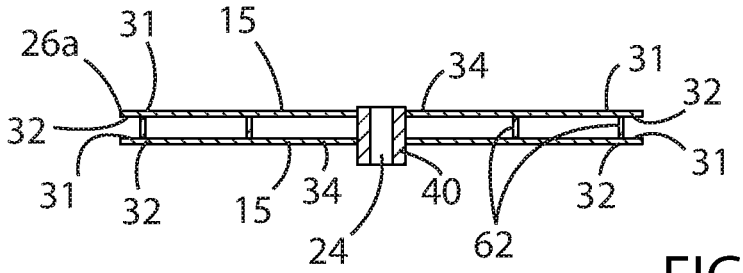
FIG. 12N is a cross-sectional side view of the plurality of rotatable rings in a stacked arrangement of FIG. 12M.
Figure 12O:
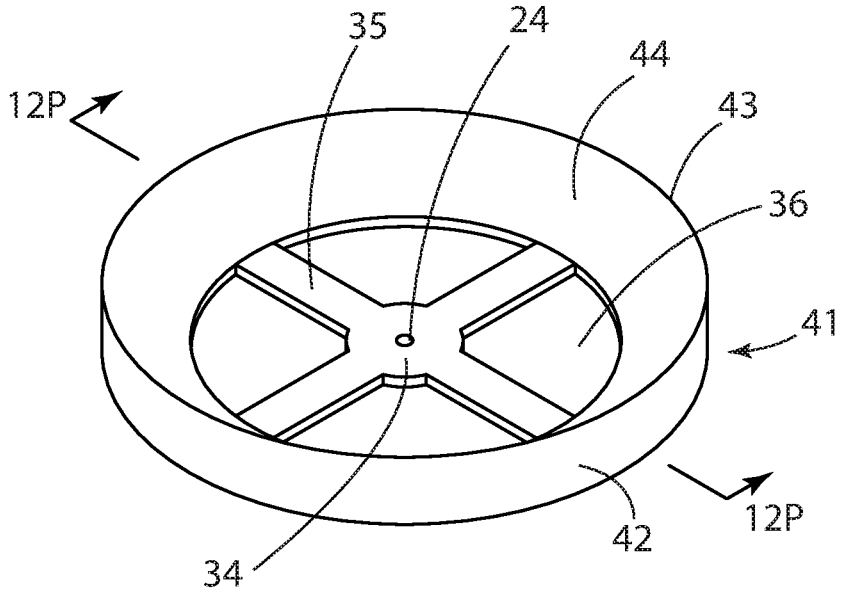
FIG. 12O is a top perspective view of still another variation of a rotatable ring of a non-sealed vacuum pump with a bladeless gas impingement surface rotatable at supersonic speed according to an example embodiment.
Figure 12P:
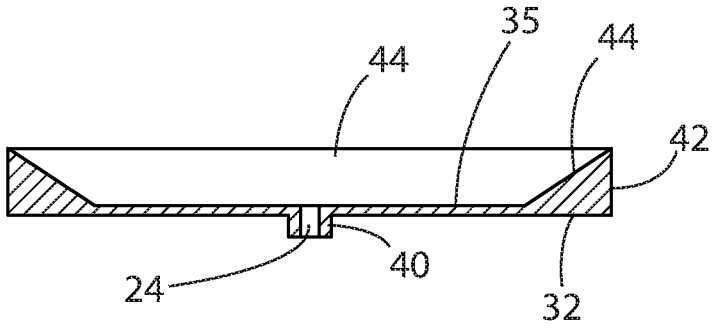
FIG. 12P is a cross-sectional side view of the rotatable ring of FIG. 12O.

In another variation illustrated in FIGS. 12M-12N, an interconnection bridge 62 may comprise a monolithic structure such as a cylinder with a wall that extends between the adjacent surfaces of the stacked rotatable surfaces 15. The cylinder wall can extend circumferentially around the central portion 23 and/or central hub portion 34 and can be positioned at a location spaced radially outward from the central opening 24 of the rotatable surface 15 between the central opening 24 and the outer peripheral edge 26*a* of the rotatable surface 15. Additional cylinders can also be employed, including being located at or near the outer peripheral edges 26*a* of the adjacent rotatable surfaces 15 if needed or desired for support. The cylinders may but need not be concentric or the same size with each other and/or with the stacked rotatable surfaces 15. The monolithic form of the interconnection bridge 62 need not be in the shape of a cylinder, but can have other geometric shapes. In the case of both the discrete and monolithic forms of the interconnection bridges 62, preferably the interconnection bridges 62 will be numbered and located to maintain the balance of the unitary structure of stacked rotatable surfaces 15 as the unitary structure is rotated with rotational and tangential velocity in the preferred supersonic range as described herein.

Each rotatable surface 15 in a stack can have the same configuration or can have a different configuration. For example, one rotatable surface 15 in the stack can be configured according to the example disk embodiment described above while another rotatable surface 15 in the stack can be configured according to the example ring embodiment as described above. The different configurations of rotatable surfaces 15 can be intermixed in the stack in any desired arrangement and order. In one example arrangement, rotatable surfaces 15 configured as rings are alternated with rotatable surfaces 15 configured as disks. Additionally, each rotatable surface 15 in a stack can have the same shape and dimensions or various rotatable surfaces 15 can have different shapes and/or different dimensions.

Each rotatable surface 15 in a stack is connected to the drive shaft 25 of the drive 16 by a coupler 40 as described above. A plurality of rotatable surfaces 15 in the stack can be connected to the drive shaft 25 together with one or more common couplers 40 as illustrated in FIGS. 12K-12N. Alternatively, one or more rotatable surfaces 15 in the stack can be individually connected to the drive shaft 25 via one or more separate individual couplers 40.

Further, all of the plurality of rotatable surfaces 15 in a stack can be rotated together with the drive shaft 25 and one or more individual rotatable surfaces 15 in a stack can be individually and selectively rotated as desired. For example, one or more rotatable surfaces 15 can each be individually connected to the drive shaft by a coupler 40 that is adapted to be remotely controlled. For example, the coupler 40 may comprise a clutch that is adapted to be remotely controlled by a linkage or other mechanism, to selectively and individually connect each rotatable surface 15 to the drive shaft 25. With this arrangement, one or more of the rotatable surfaces 15 in the stack can be selectively rotated at various times in order to achieve desired pumping characteristics, for example to increase efficiency or to increase flow rate and volume. As another example, an example embodiment of the vacuum pump 10 could be controlled to select one or more rotatable surfaces 15 to rotate with tangential velocity $v_t$ in the preferred range described herein when pressure in the low pressure portion 11 is at and near the starting or ambient pressure, and as the pressure drops to select one or more additional or different rotatable surfaces 15 to rotate with the same or different tangential velocity $v_t$ in the preferred range to alter the pumping characteristics. For example, as the pressure drops, additional or different rotatable surfaces 15 could be selectively rotated to increase the surface area for impingement of the gas molecules to try to maintain a substantially uniform flow rate and volume.

The foregoing description of several specific example embodiments of a non-sealed vacuum pump with supersonically rotatable bladeless gas impingement surface and various components and elements thereof are given for illustrative purposes only and are not intended and should not be interpreted as limiting or precluding other embodiments that may be possible. Persons of ordinary skill in the art will appreciate that a wide variety of modifications and alterations may be made to and/or substituted for the specific example embodiments, components, and elements shown and described herein without departing from the spirit or scope of the present disclosure or of the present invention, and that various aspects of the specific example embodiments shown and described can be combined in various ways to achieve still further embodiments. The scope of the invention that is the subject of this application, including any adaptations or variations of the embodiments whether or not specifically discussed herein, is therefore intended to be defined by the appended claims.

What is claimed is:

1. A vacuum pump for pumping a gas, comprising:

an outer enclosure that is substantially gas impermeable, wherein the outer enclosure defines an interior space with an interior surface;

a rotatable disk or ring in the interior space, wherein the rotatable disk or ring has a first surface, a second surface opposite of the first surface, and a peripheral edge between the first surface and the second surface, and wherein the first surface and the second surface are substantially flat;

wherein the rotatable disk or ring is arranged to separate the interior space into a low pressure portion and a high pressure portion with the first surface facing the low pressure portion and the second surface facing the high pressure portion;

wherein the outer enclosure has a first apex that is spaced from the first surface and the interior surface slopes substantially continuously outward from at or near the first apex around substantially the entire peripheral edge of the rotatable disk or ring in the low pressure portion of the interior space;

wherein the peripheral edge of the rotatable disk or ring and the interior surface of the outer enclosure define a first gap, wherein the gas is able to flow between the low pressure portion and the high pressure portion through the first gap while the vacuum pump is pumping the gas and there is no seal to prevent the gas from flowing between the high pressure portion and the low pressure portion through the first gap, wherein the first gap has a first dimension that is related to the length of the mean free path of the gas at a predetermined target minimum pressure in the low pressure portion so that the first gap is able to conduct a net outflow of the gas from the low pressure portion to the high pressure portion while the vacuum pump is pumping the gas until the pressure in the low pressure portion reaches the target minimum pressure;

a drive coupled to the rotatable disk or ring, wherein the drive is operable to rotate the rotatable disk or ring with at least a portion of the first surface and the second surface having tangential velocity in the range of approximately 1 to 6 times the most probable velocity of the molecules of the gas over a range of pressures in the low pressure portion from a starting pressure to the target minimum pressure to cause the molecules of the gas impinging on the rotatable disk or ring to flow outwardly from the peripheral edge of the rotatable disk or ring through the first gap to reduce the pressure in the low pressure portion from the starting pressure to the predetermined target minimum pressure in a single pumping stage;

a second enclosure in the high pressure portion, wherein the second enclosure is substantially gas impermeable, defines a second interior space that is adjacent to the second surface of the rotatable disk or ring, has a second apex that is spaced from the second surface, and has a surface that slopes outwardly from the second apex toward the peripheral edge of the rotatable disk or ring in the high pressure portion and terminates just inwardly of the peripheral edge around substantially the entire peripheral edge;

wherein the peripheral edge of the rotatable disk or ring and the surface of the second enclosure define a second gap having a second dimension wherein the second interior space and the high pressure portion are in gaseous communication via the second gap;

wherein the second dimension of the second gap is slightly less than the first dimension of the first gap to reduce a pressure differential between the first surface and the second surface while the pump is pumping the gas.

2. The vacuum pump of claim 1, wherein the starting pressure is about 1 atm and the target minimum pressure is in the range of approximately $10^{-4}$ to $10^{-6}$ atm.

3. The vacuum pump of claim 1, wherein the outer enclosure comprises an inlet in gaseous communication with the low pressure portion and an outlet in gaseous communication with the high pressure portion.

4. The vacuum pump of claim 1, wherein the first dimension of the first gap is in the range of approximately 0.5 mm to approximately 100 mm.

5. The vacuum pump of claim 1, wherein the rotatable ring comprises a substantially circular ring with a central opening, a radius dimension between the central opening and the peripheral edge, an interior open portion and a peripheral surface portion with a dimension in the range of approximately 0.05 to less than 0.5 times the radius dimension.

6. The vacuum pump of claim 1, comprising a plurality of substantially parallel planar rotatable disks or rings arranged in a stacked configuration.

7. The vacuum pump of claim 1, wherein the drive is operable to rotate the rotatable disk or ring with at least a portion of the rotatable disk or ring having a tangential velocity having a first velocity value when the pressure in the low pressure portion is approximately the starting pressure and having one or more second velocity values that are progressively greater than the first velocity value as the pressure in the low pressure portion is reduced toward the target minimum pressure.

8. A vacuum pump for pumping a gas, comprising:

an outer enclosure that is substantially gas impermeable, wherein the outer enclosure defines an interior space with an interior surface;

a rotatable surface in the interior space, wherein the rotatable surface has a first surface, a second surface opposite of the first surface, and a peripheral edge between the first surface and the second surface, and wherein the first surface and the second surface are substantially flat;

wherein the rotatable surface is arranged to separate the interior space into a low pressure portion and a high pressure portion with the first surface facing the low pressure portion and the second surface facing the high pressure portion;

wherein the outer enclosure has an apex that is spaced from the first surface and the interior surface slopes substantially continuously outward from at or near the first apex around the peripheral edge of the rotatable surface in the low pressure portion of the interior space;

wherein the peripheral edge of the rotatable surface and the interior surface of the outer enclosure define a first gap, wherein the gas is able to flow between the low pressure portion and the high pressure portion through the first gap while the vacuum pump is pumping the gas and there is no seal to prevent the gas from flowing between the high pressure portion to and the low pressure portion through the first gap, wherein the first gap has a first dimension that is related to the length of the mean free path of the gas at a predetermined target minimum pressure in the low pressure portion so that the first gap is able to conduct a net outflow of the gas from the low pressure portion to the high pressure portion while the vacuum pump is pumping the gas until the pressure in the low pressure portion reaches the target minimum pressure;

a drive coupled to the rotatable surface, wherein the drive is operable while the pump is pumping the gas to rotate the rotatable surface with at least a portion of the rotatable surface having a tangential velocity in the range of approximately 1 to 6 times the most probable velocity of the molecules of the gas over a range of pressures in the low pressure portion from a starting pressure when the pump begins pumping the gas to the target minimum pressure to cause the molecules of the gas impinging on the rotatable surface to flow outwardly from the peripheral edge of the rotatable surface through the first gap to reduce the pressure in the low pressure portion from the starting pressure to the predetermined target minimum pressure in a single pumping stage.

9. The vacuum pump of claim 8, wherein the starting pressure is about 1 atm and the target minimum pressure is in the range of approximately $10^{-4}$ to $10^{-6}$ atm.

10. The vacuum pump of claim 8, wherein the first dimension of the first gap is in the range of approximately 0.5 mm to approximately 100 mm.

11. The vacuum pump of claim 8, wherein the rotatable surface comprises a substantially circular ring with a central opening, a radius dimension between the central opening and the peripheral edge, an interior open portion and a peripheral surface portion with a dimension in the range of approximately 0.05 to less than 0.5 times the radius dimension.

12. The vacuum pump of claim 8, comprising a plurality of substantially parallel planar rotatable surfaces arranged in a stacked configuration.

13. The vacuum pump of claim 8, wherein the drive is operable to rotate the rotatable surface with at least a portion of the rotatable surface having a tangential velocity having a first velocity value when the pressure in the low pressure portion is approximately the starting pressure and having one or more second velocity values that are progressively greater than the first velocity value as the pressure in the low pressure portion is reduced toward the target minimum pressure.

14. A vacuum pump for pumping a gas, comprising:

an outer enclosure that is substantially gas impermeable, wherein the outer enclosure defines an interior space with an interior surface;

a plurality of rotatable rings arranged in a stack in the interior space, wherein the stack has a top ring and a bottom ring, wherein each ring of the plurality of rings is substantially circular and has an interior open portion, an axis of rotation, a peripheral edge, a first peripheral surface around the peripheral edge, and a second peripheral surface around the peripheral edge opposite of the first peripheral surface, wherein the first peripheral surface and the second peripheral surface are substantially flat;

wherein the stack of rotatable rings separates the interior space into a low pressure portion and a high pressure portion with the first peripheral surface of the top ring facing the low pressure portion and the second peripheral surface of the bottom ring facing the high pressure portion;

wherein the outer enclosure has an apex that is spaced from the first surface of the top ring and the interior surface slopes substantially continuously outward from at or near the apex around the peripheral edges of the stack of rotatable rings in the low pressure portion of the interior space;

wherein the peripheral edge of the top ring and the interior surface of the outer enclosure define a first gap, wherein the gas is able to flow between the low pressure portion and the high pressure portion through the first gap while the vacuum pump is pumping the gas there is no seal to prevent the gas from flowing between the high pressure portion and the low pressure portion through the first gap, wherein the first gap has a first dimension that is related to the length of the mean free path of the gas at a predetermined target minimum pressure in the low pressure portion so that the first gap is able to conduct a net outflow of the gas from the low pressure portion to the high pressure portion while the vacuum pump is pumping the gas until the pressure in the low pressure portion reaches the target minimum pressure;

a drive coupled to the stack of rotatable rings, wherein the drive is operable while the vacuum pump is pumping the gas to rotate the stack of rotatable rings with at least a portion of the first peripheral surface and the second peripheral surface of at least the top ring having a tangential velocity in the range of approximately 1 to 6 times the most probable velocity of the molecules of the gas to cause the molecules of the gas in the low pressure portion to flow outwardly through the first gap to reduce the pressure in the low pressure portion.

15. The vacuum pump of claim 14, wherein the target minimum pressure is at least as low as approximately 0.5 atm.

16. The vacuum pump of claim 14, wherein the drive is operable while the vacuum pump is pumping the gas to rotate the stack of rotatable rings with at least a portion of the first peripheral surface and the second peripheral surface of each ring having a tangential velocity in the range of approximately 1 to 6 times the most probable velocity of the molecules of the gas over a range of pressures in the low pressure portion from a starting pressure when the pump begins pumping the gas to the target minimum pressure.

17. The vacuum pump of claim 16, wherein the starting pressure is about 1 atm and the target minimum pressure is in the range of approximately $10^{-4}$ to $10^{-6}$ atm.

18. The vacuum pump of claim 14, wherein the drive is operable while the vacuum pump is pumping the gas to rotate the stack of rotatable rings with at least a portion of the first peripheral surface and the second peripheral surface of each ring having a tangential velocity with a first velocity value when the pressure in the low pressure portion is at a predetermined starting value and with one or more second velocity values that are progressively greater than the first velocity value as the pressure in the low pressure portion is reduced toward the target minimum pressure.

19. A vacuum pump for pumping a gas, comprising:

an outer enclosure that is substantially gas impermeable, wherein the outer enclosure defines an interior space with an interior surface;

a rotatable surface in the interior space, wherein the rotatable surface has a first surface, a second surface opposite of the first surface, and a peripheral edge between the first surface and the second surface, and wherein the first surface and the second surface are substantially flat and featureless;

wherein the rotatable surface is arranged to separate the interior space into a low pressure portion and a high pressure portion with the first surface facing the low pressure portion and the second surface facing the high pressure portion;

wherein the outer enclosure has an apex that is spaced from the first surface and the interior surface slopes substantially continuously from at or near the first apex toward the peripheral edge of the rotatable surface and extends around the peripheral edge;

wherein the peripheral edge and the interior surface define a first gap, wherein the gas is able to flow between the low pressure portion and the high pressure portion through the first gap while the vacuum pump is pumping the gas and there is no seal to prevent the gas from flowing between the high pressure portion and the low pressure portion through the first gap, wherein the first gap has a first dimension, that is related to the length of the mean free path of the gas at a predetermined target minimum pressure in the low pressure portion so that the first gap is able to conduct a net outflow of the gas from the low pressure portion to the high pressure portion while the vacuum pump is pumping the gas until the pressure in the low pressure portion reaches the target minimum pressure; and a drive coupled to the rotatable surface and operable to cause the rotatable surface to rotate with at least a portion of the surface having a tangential velocity that is sufficient to cause molecules of the gas in the space between the apex and the rotatable surface that impinge on the surface to be directed toward the peripheral edge and through the first gap into the high pressure portion to reduce the pressure of the gas in the low pressure portion.

20. A method of operating the vacuum pump of claim 19, comprising:

introducing the gas into the space between the apex and the rotatable surface in the low pressure portion; and operating the drive to rotate the rotatable surface with at least a portion of the rotatable surface having a tangential velocity in the range of approximately 1 to 6 times the most probable velocity of the molecules of the gas until the pressure of the gas in the low pressure portion is reduced from a starting pressure when the pump begins pumping the gas to the target minimum pressure in a single pumping stage.

21. The method of claim 20 wherein the starting pressure is about 1 atm and the minimum target pressure is at least as low as approximately 0.5 atm.

22. The method of claim 20 wherein the starting pressure is about 1 atm and the minimum target pressure is in a range of approximately $10^{-4}$ to $10^{-6}$ atm.

* * * * *